US012331510B2

(12) United States Patent
Sherman

(10) Patent No.: US 12,331,510 B2
(45) Date of Patent: Jun. 17, 2025

(54) WALL CLADDING PANELS, SYSTEMS, AND METHODS OF INSTALLATION AND USE

(71) Applicant: John William Thomas Sherman, Edmonton (CA)

(72) Inventor: John William Thomas Sherman, Edmonton (CA)

( * ) Notice: Subject to any disclaimer, the term of this patent is extended or adjusted under 35 U.S.C. 154(b) by 215 days.

(21) Appl. No.: 17/939,580

(22) Filed: Sep. 7, 2022

(65) Prior Publication Data

US 2023/0399841 A1 Dec. 14, 2023

Related U.S. Application Data

(60) Provisional application No. 63/351,269, filed on Jun. 10, 2022.

(51) Int. Cl.
*E04B 1/76* (2006.01)
*E04F 13/08* (2006.01)

(52) U.S. Cl.
CPC ..... *E04B 1/7629* (2013.01); *E04F 13/0801* (2013.01); *E04F 13/0866* (2013.01)

(58) Field of Classification Search
CPC ..... E04B 1/7629; E04B 1/40; E04F 13/0853; E04F 13/0801; E04F 13/0866
USPC ..... 52/302.1
See application file for complete search history.

(56) References Cited

U.S. PATENT DOCUMENTS 2,023,452 A 12/1935 Voegeli
2,231,008 A 2/1941 Ochs
2,264,546 A 12/1941 Ochs
2,961,804 A 11/1960 Beckman
3,046,700 A 7/1962 Davenport
3,064,320 A * 11/1962 Blaszkowski ..... E06B 3/62 52/204.593

(Continued)

FOREIGN PATENT DOCUMENTS

CA 2549707 12/2007
CA 2683024 4/2010

(Continued)

OTHER PUBLICATIONS

Rodenhouse Fastening Systems, Thermal-Grip Impaling Fastener, available at least as early as Jan. 21, 2021, 2 pages.

(Continued)

*Primary Examiner* — Paola Agudelo
(74) *Attorney, Agent, or Firm* — Robert A. Nissen

(57) ABSTRACT

A panel system provides a prefabricated exterior building façade. Various wall claddings and clips for hanging wall claddings are discussed. Panel connector parts are disclosed for hanging wall cladding panels against a building wall. Panel connector parts are disclosed for hanging dual layers of insulating material against a building wall with a drainage cavity or gap defined between the dual layers. A wall cladding system includes: a building wall; a plurality of wall cladding panels each comprising insulating material and defining an external face, a rear face, and side edges, with adjacent of the wall cladding panels abutting one another along respective side edges; panel connector parts mounted on the building wall and mounting the plurality of wall cladding panels as a continuous thermal break layer against the building wall.

26 Claims, 21 Drawing Sheets

(56) References Cited

U.S. PATENT DOCUMENTS

| | | | | |
|---|---|---|---|---|
| 4,597,235 | A * | 7/1986 | Olsen | E04F 13/0803 52/762 |
| 4,973,506 | A | 11/1990 | Bauer | |
| 5,060,441 | A * | 10/1991 | Pichette | E04B 1/7666 52/855 |
| 5,239,798 | A | 8/1993 | Saito | |
| 5,280,689 | A | 1/1994 | Mill | |
| 5,517,883 | A | 5/1996 | Goldi | |
| 5,765,330 | A | 6/1998 | Richard | |
| 6,039,525 | A | 3/2000 | Johnson | |
| 6,108,991 | A | 8/2000 | Hagan | |
| 6,279,286 | B1 * | 8/2001 | Ichihashi | E04F 13/0826 52/489.1 |
| 6,598,362 | B2 * | 7/2003 | Hikai | E04F 13/0846 52/235 |
| 6,786,013 | B2 | 9/2004 | Coulton | |
| 8,336,275 | B2 | 12/2012 | Rodenhouse | |
| 8,511,014 | B2 | 8/2013 | Delforte | |
| 8,555,581 | B2 | 10/2013 | Amend | |
| 8,596,009 | B2 * | 12/2013 | Baxter | E04B 9/067 52/489.1 |
| 8,898,978 | B2 | 12/2014 | Murray | |
| 8,919,062 | B1 * | 12/2014 | Viness | E04F 13/04 52/302.6 |
| 8,979,052 | B2 * | 3/2015 | Uota | E04F 13/0801 403/381 |
| 9,140,001 | B1 | 9/2015 | Hohmann, Jr. | |
| D748,973 | S | 2/2016 | Rodenhouse | |
| D749,941 | S | 2/2016 | Rodenhouse | |
| 9,309,676 | B1 | 4/2016 | Szalacinski | |
| 9,359,771 | B1 | 6/2016 | Delforte | |
| 9,518,393 | B2 * | 12/2016 | Bordener | E04F 13/0826 |
| 9,540,804 | B1 * | 1/2017 | Farahmandpour | E04F 13/0826 |
| 9,822,529 | B1 | 11/2017 | Al-Salloum | |
| 9,890,807 | B1 | 2/2018 | Rodenhouse | |
| 9,945,414 | B1 * | 4/2018 | Rodenhouse | F16B 43/001 |
| 10,508,454 | B2 * | 12/2019 | Suzuki | E04F 13/0846 |
| D874,251 | S | 2/2020 | Neuhofer, Jr. | |
| 10,876,285 | B1 * | 12/2020 | Wigboldy | E04B 1/4178 |
| 10,961,699 | B2 * | 3/2021 | Campacci | B32B 19/06 |
| 11,078,664 | B1 * | 8/2021 | Wigboldy | E04B 1/7629 |
| 2001/0004821 | A1 | 6/2001 | Kaneko | |
| 2003/0196398 | A1 | 10/2003 | Hasan | |
| 2007/0130871 | A1 | 6/2007 | Johnson | |
| 2007/0180791 | A1 | 8/2007 | Amster | |
| 2007/0186501 | A1 | 8/2007 | Kuelker | |
| 2008/0155928 | A1 | 7/2008 | Weiss | |
| 2008/0260993 | A1 | 10/2008 | Koester | |
| 2008/0276557 | A1 | 11/2008 | Rapaz | |
| 2008/0295450 | A1 | 12/2008 | Yogev | |
| 2009/0094923 | A1 * | 4/2009 | Weir | E04B 1/7629 52/506.01 |
| 2009/0199499 | A1 | 8/2009 | Collier | |
| 2010/0019014 | A1 | 1/2010 | Rodenhouse | |
| 2012/0031022 | A1 | 2/2012 | Morgan | |
| 2013/0036699 | A1 * | 2/2013 | Holt | E04B 1/7629 403/336 |
| 2013/0174506 | A1 * | 7/2013 | Bombino | E04B 1/388 52/750 |
| 2014/0007396 | A1 * | 1/2014 | Jones | E06B 3/585 29/428 |
| 2014/0072735 | A1 * | 3/2014 | Jones | E06B 3/6612 428/34 |
| 2014/0174012 | A1 * | 6/2014 | Di Scola | E04F 13/14 52/475.1 |
| 2014/0260048 | A1 * | 9/2014 | Schaefer | E04F 13/0878 52/741.1 |
| 2014/0345223 | A1 * | 11/2014 | Miks | E04B 2/562 52/309.4 |
| 2015/0240858 | A1 | 8/2015 | Bertovic | |
| 2016/0215497 | A1 | 7/2016 | Fritz | |
| 2017/0009449 | A1 | 1/2017 | Leën | |
| 2017/0130464 | A1 * | 5/2017 | Gleeson | E04F 13/0846 |
| 2017/0183865 | A1 | 6/2017 | Martel | |
| 2018/0155878 | A1 | 6/2018 | Gumbert | |
| 2018/0155924 | A1 * | 6/2018 | An | E04B 1/7637 |
| 2018/0209154 | A1 * | 7/2018 | Ausseur | E04F 13/072 |
| 2019/0017279 | A1 | 1/2019 | Norwood | |
| 2019/0093369 | A1 | 3/2019 | Sharpe | |
| 2019/0211565 | A1 | 7/2019 | Hascher | |
| 2019/0309525 | A1 | 10/2019 | Santarossa | |
| 2020/0141127 | A1 | 5/2020 | Loyd | |
| 2022/0162860 | A1 * | 5/2022 | Sherman | E04F 13/0833 |
| 2023/0069389 | A1 * | 3/2023 | Jansen Van Vuuren | E04B 1/388 |
| 2023/0235550 | A1 * | 7/2023 | Long | E04B 1/942 52/235 |

FOREIGN PATENT DOCUMENTS

| | | |
|---|---|---|
| CA | 2743964 | 12/2012 |
| CA | 3073481 | 4/2019 |
| CN | 109779133 | 5/2019 |
| CN | 110259038 | 9/2019 |
| DE | 29619728 | 1/1997 |
| DE | 19704112 | 6/1998 |
| DE | 19581698 | 10/1998 |
| DE | 102016100739 | 7/2016 |
| EP | 0204015 | 12/1986 |
| EP | 0340607 | 11/1989 |
| EP | 2305910 | 4/2011 |
| EP | 2851193 | 3/2015 |
| EP | 2857609 | 4/2015 |
| FR | 2944036 | 10/2010 |
| GB | 470349 | 8/1937 |
| GB | 2137251 | 10/1984 |
| GB | 2262547 | 6/1993 |
| GB | 2559113 | 8/2018 |
| KR | 101447360 | 10/2014 |
| WO | 2007090264 | 8/2007 |
| WO | 2009007103 | 1/2009 |
| WO | 2010122353 | 10/2010 |
| WO | 2010139681 | 12/2010 |
| WO | 2011154929 | 12/2011 |
| WO | 2013190234 | 12/2013 |
| WO | 2014095277 | 6/2014 |
| WO | 2015024134 | 2/2015 |
| WO | 2015131283 | 9/2015 |
| WO | 2017122840 | 7/2017 |
| WO | 2019035724 | 2/2019 |
| WO | 2019048467 | 3/2019 |
| WO | 2019074866 | 4/2019 |

OTHER PUBLICATIONS

Rhino Steel Building Systems, I Ain't Afraid of No Ghosting, Mar. 16, 2018, 6 pages.

ACS Composite Systems Inc., Thermal Break Wall Systems, 20 pages, Oct. 2015.

Nichiha Fiber Cement, KuraStone Installation Guide, 18 pages, Sep. 2019.

Masonry Technology Incorporated, Vertical Siding at Bottom of Wall with Horizontal Nailer and Drainage Strip Detail, believed to be available as early as May 2018, 1 page.

AL13 Architectural Systems, AL13 Panel System Installation Guide, believed to be available as early as Aug. 2019, 31 pages.

BASF Canada Inc., Slentex brochure, available as early as Nov. 15, 2019, 4 pages.

Nichiha, Commercial Applications—fiber cement cladding, screenshot of webpage, believed to be available as early as Oct. 2019, 7 pages, URL = https://www.nichiha.com/commercial-applications.

* cited by examiner 42
42H
42A
42F
42D
42B
42E
42H
5
5
42I
42D
42
42
42F
42E
42B
40B
42A
42G
42B
42E
42D
42I
42I
42D
42F
40B
44G
42B
40G
12
12A
44B
44
10
11
44A
14
44H
22
42E
42A
40G
40D
40D
6
6
40
40D-2A
12G
40J
40K
40I
40H
40C
40M
40H
40B
40A
40
40
40D-2A
40D, 40D-2
40A
40G
40J
40H
40K
40I
40C
40J
40G
40B
40A
40D, 40D-1
40
40B
40D
40G
40A
40M
40G
40M
40H 10
12J
44C
12
46C
12C
44A
42
44E
12E
46E
12H
12G
12B
42H
46D
12D
44
12A
46
12F
42D
42E
14
12I
42A
42B
44F
44A
42I
42H
44D
46A
46
44
12P
60
30
12, 12'''
48
12C
24'''
50
12H
42D
12G
12, 12''
22
44H
46F
42I
50
48
46C
12D
44D
12, 12'
14
12A
12B
46B
24'
34A
46A
34C
12D-1
34
52
52A
40A
40B
40C
40D
40G
40H
40M
10
46C
12C
18
42E
42I
9
40A
52
40B
42A
40D
42F
40H
44A
40
46B
14
40C
46A
12G
44B
44
16
42B
42D
44H
46
46G,
46H
12B
48
12D
12H
46D
44D
40
46D
34B
32B
32
32A
28
62
26
11

40

40

40H
66A
40P
68D
66D
68
70
66C
66E
66B
40H
68
68E
68D
40
40H-1
66C
66B
70
40
40R
40H
72
58
40
40P
40R
68
66A
40H
40H-2
72
40K
66E
40P
58
58C 40H-1
66D
68A
68
68E
68D
66
68F
68B
68C
66C
70
66E
66A
58C
66B 10
26
45
11
28
30
44C'
60
12'
12
40'''
44E
40H''
40''
34A
34G
34
40'
32
44B'
44D'
18
44F'
44, 44'
22
44A
52
44C'
44,
44''
44B
40H
66G
66
44D''
40H''
58
56
44A'
66
34A
32A
40'
32B
34C
34B

Fig. 62
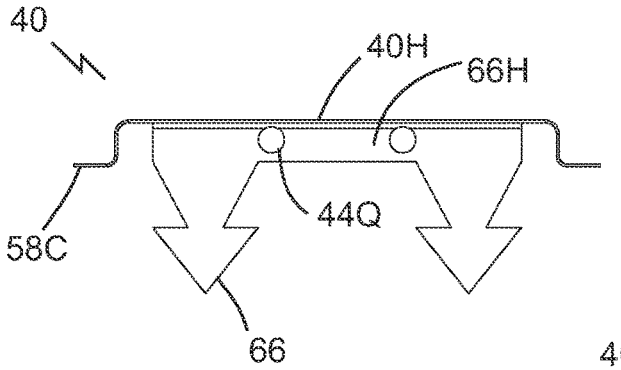
Fig. 67
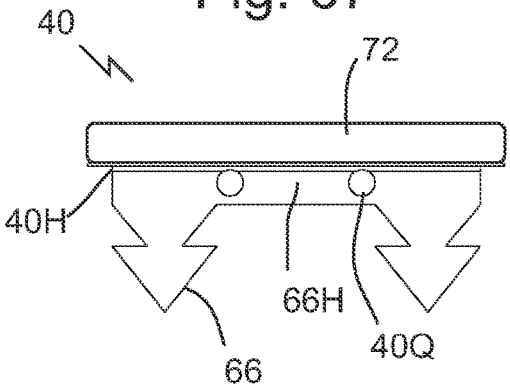
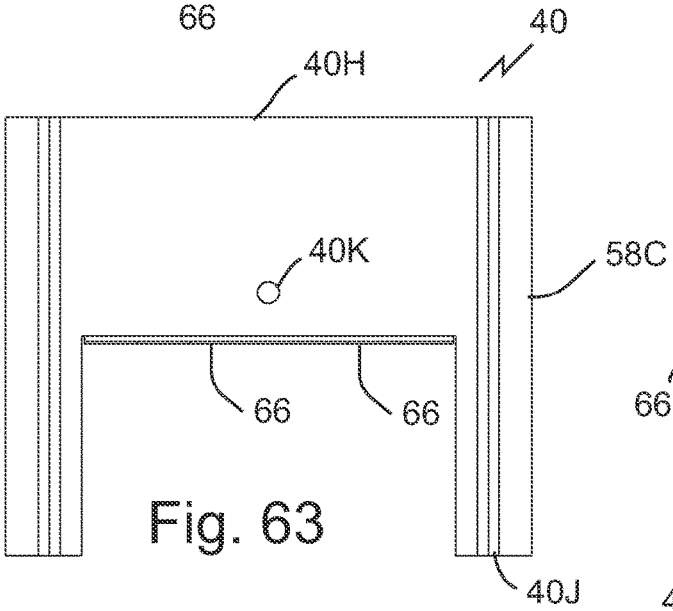
Fig. 63
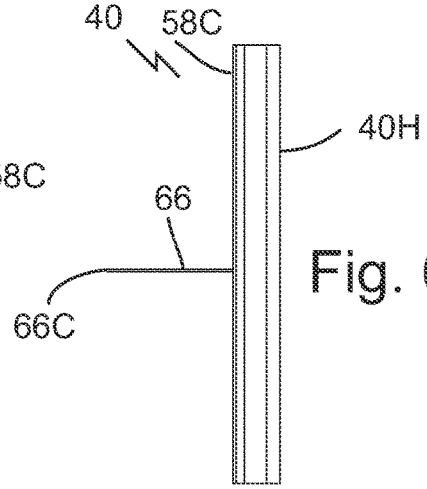
Fig. 64
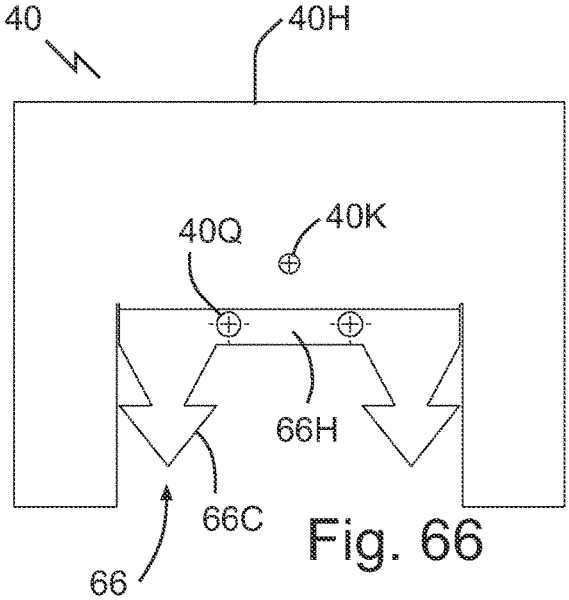
Fig. 66
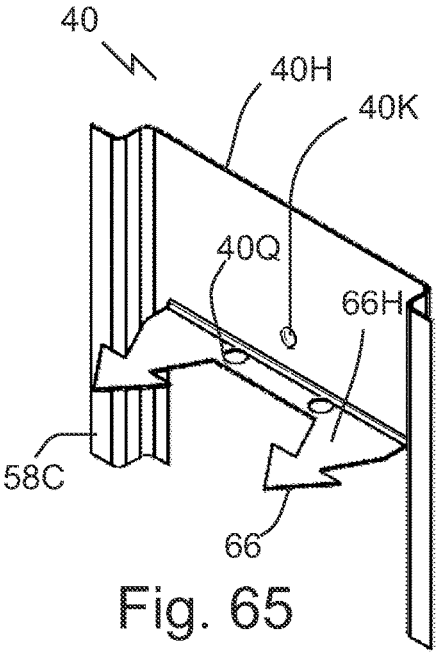
Fig. 65

Fig. 68
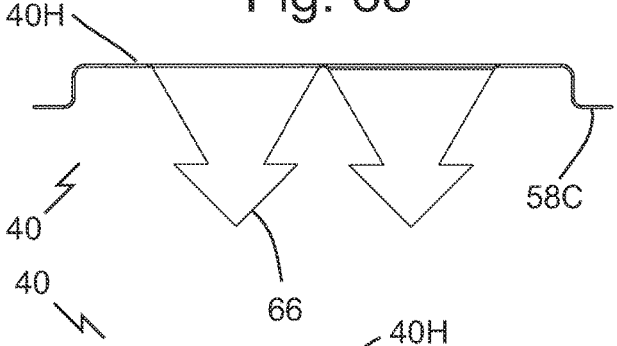
Fig. 73
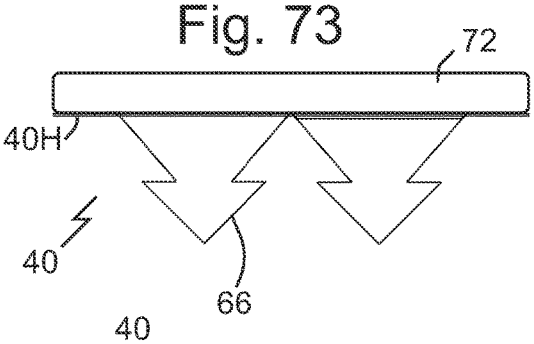
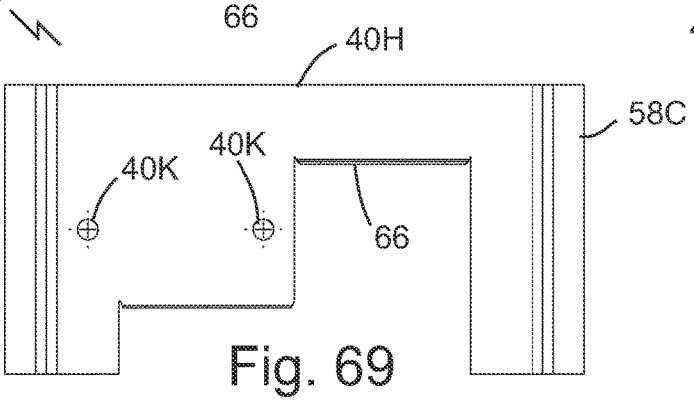
Fig. 69
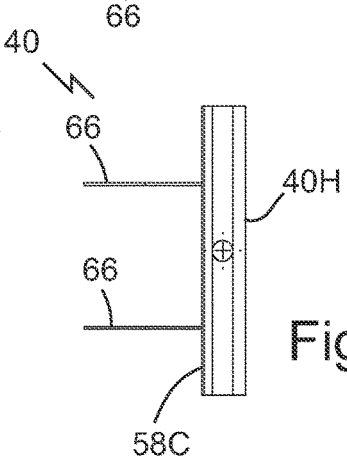
Fig. 70
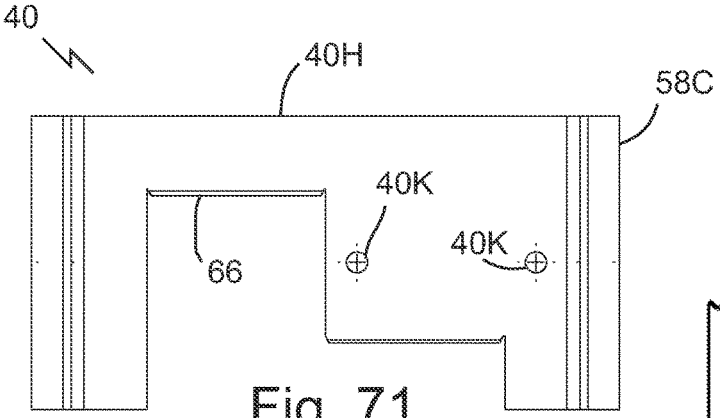
Fig. 71
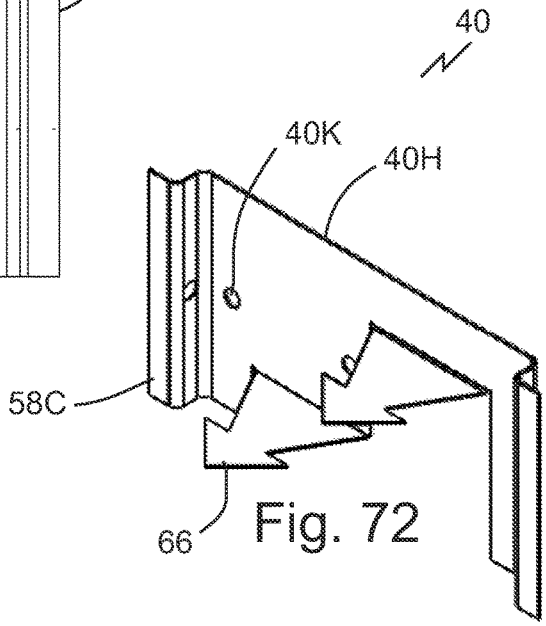
Fig. 72

WALL CLADDING PANELS, SYSTEMS, AND METHODS OF INSTALLATION AND USE

TECHNICAL FIELD

This document relates to wall cladding panels, systems, and methods of installation and use.

BACKGROUND

Wall cladding systems are used to finish the exterior of a building. Such systems use a plurality of parts that are assembled on site, such as insulating panels, rainscreens, vapor barrier membranes, fire retardants, and finishing coatings such as paint. Wall cladding systems that incorporate insulating panels have thermal bridges across the hangers and S-clips that bridge the transitions between abutting adjacent panels.

SUMMARY

A panel system is disclosed to provide a prefabricated exterior building façade. Various wall cladding systems for hanging wall claddings are disclosed. Panel connector parts are disclosed for hanging wall cladding panels against a building wall, such as an external building wall. Panel connector parts are disclosed for hanging dual layers of insulating material against a building wall with a drainage cavity or gap defined between the dual layers.

A wall cladding system comprising: a building wall; a plurality of wall cladding panels each comprising insulating material and defining an external face, a rear face, and side edges, with adjacent of the wall cladding panels abutting one another along respective side edges; panel connector parts mounted on the building wall and mounting the plurality of wall cladding panels as a continuous thermal break layer against the building wall.

A wall cladding system is disclosed comprising: a building wall; a plurality of wall cladding panels each comprising a layer of insulating material and defining an external face, a rear face, a front face, and side edges, with adjacent of the wall cladding panels abutting one another along respective side edges; panel connector parts mounted on the building wall and engaging one or more of: a) the rear faces of the plurality of wall cladding panels at interior locations, spaced from the side edges, of each of the plurality of wall cladding panels, or b) the edges of the plurality of wall cladding panels at intermediate locations, spaced from front faces, of each of the plurality of wall cladding panels, to mount the plurality of wall cladding panels as a continuous thermal break layer against the building wall.

A method is disclosed of assembling a wall cladding system on a building wall, the method comprising: mounting a plurality of panel connector parts along the building wall; mounting a plurality of wall cladding panels along an exterior of the building wall, such that the plurality of panel connector parts align and engage one or more of: a) the rear face of, and at interior locations, spaced from the side edges of, each of the plurality of wall cladding panels, or b) the edges of, and at intermediate locations, spaced from a front face of, of each of the plurality of wall cladding panels, to mount the plurality of wall cladding panels as a continuous thermal break layer against the building wall.

A kit is disclosed comprising: a plurality of wall cladding panels each comprising insulating material and defining an external face, a rear face, and side edges, with the side edges of the wall cladding panels structured to mate with abutting side edges of adjacent of the wall cladding panels in use; panel connector parts, in which the panel connector parts are structured to mount to the building wall at suitable locations, and to mount the plurality of wall cladding panels as a continuous thermal break layer against the building wall when the panel connector parts are mounted to the building wall, by engaging one or more of: a) the rear face of, and at interior locations, spaced from the side edges of, each of the plurality of wall cladding panels, or b) the edges of, and at intermediate locations, spaced from front faces of, each of the plurality of wall cladding panels.

A wall cladding system is disclosed comprising: a building wall; a plurality of wall cladding panels each comprising insulating material and defining an external face, a rear face, and side edges, with adjacent of the wall cladding panels abutting one another along respective side edges; wall connector parts arranged on the rear face of, and at interior locations, spaced from the side edges, of each of the plurality of wall cladding panels; panel connector parts mounted on the building wall; and in which the wall connector parts and the panel connector parts interlock to mount the plurality of wall cladding panels as a continuous thermal break layer against the building wall.

A method is disclosed of assembling a wall cladding system on a building wall, the method comprising: mounting a plurality of panel connector parts along the building wall; positioning a plurality of wall cladding panels along an exterior of the building wall, such that wall connector parts, which are arranged on a rear face of, and at interior locations, spaced from side edges of, each of the plurality of wall cladding panels, align with the panel connector parts; and interlocking the panel and panel connector parts to mount the plurality of wall cladding panels as a continuous thermal break layer against the building wall.

A kit is disclosed comprising: a plurality of wall cladding panels each comprising insulating material and defining an external face, a rear face, and side edges, with the side edges of the wall cladding panels structured to mate with abutting side edges of adjacent of the wall cladding panels in use; wall connector parts arranged on the rear face of, and at interior locations, spaced from the side edges, of each of the plurality of wall cladding panels; panel connector parts; and in which the wall connector parts are structured to interlock with the panel connector parts to mount the plurality of wall cladding panels as a continuous thermal break layer against a building wall when the panel connector parts are mounted to the building wall.

A wall cladding system is disclosed comprising: a building wall; a plurality of wall cladding panels each comprising insulating material and defining an external face, a rear face, and side edges, with adjacent of the wall cladding panels abutting one another along respective side edges; panel connector parts mounted on the building wall and engaging the rear faces of the plurality of wall cladding panels at interior locations, spaced from the side edges, of each of the plurality of wall cladding panels, to mount the plurality of wall cladding panels as a continuous thermal break layer against the building wall.

A method is disclosed of assembling a wall cladding system on a building wall, the method comprising: mounting a plurality of panel connector parts along the building wall; mounting a plurality of wall cladding panels along an exterior of the building wall, such that the plurality of panel connector parts align and engage with a rear face of, and at interior locations, spaced from side edges of, each of the plurality of wall cladding panels, to mount the plurality of wall cladding panels as a continuous thermal break layer against the building wall.

A kit is disclosed comprising: a plurality of wall cladding panels each comprising insulating material and defining an external face, a rear face, and side edges, with the side edges of the wall cladding panels structured to mate with abutting side edges of adjacent of the wall cladding panels in use; panel connector parts, in which the panel connector parts are structured to mount to the building wall at suitable locations, and to mount the plurality of wall cladding panels as a continuous thermal break layer against the building wall when the panel connector parts are mounted to the building wall, by engaging the rear face of, and at interior locations, spaced from the side edges, of each of the plurality of wall cladding panels.

In various embodiments, there may be included any one or more of the following features: The building wall comprises a first layer of insulating material and a wall frame; the panel connector parts are mounted on and secure the first layer of insulating material to the wall frame; and the layer of insulating material of each of the plurality of wall cladding panels is a second layer of insulating material that overlies, and is secured by the panel connector parts to, the first layer of insulating material. One or both of the first layer of insulating material and the second layer of insulating material comprise mineral wool. The panel connector parts are secured to the wall frame via fasteners. The panel connector parts are structured to space the rear faces of the plurality of wall cladding panels off of the first layer of insulating material to define a drainage cavity. The panel connector parts are structured to space the rear faces of the plurality of wall cladding panels off of the building wall to define a drainage cavity. One or more drainage spacer parts extend out of the base wall mount in a lateral direction to space the rear faces of the building wall to define the drainage cavity. The one or more drainage spacer parts each comprise an insulating backing layer. The panel connector parts each comprise: a base wall mount; and one or more wall anchor parts that extend out of a rear face of the base wall mount in a lateral direction into the building wall. The one or more wall anchor parts comprise wall lance parts. Adhesive secures the plurality of wall cladding panels to the building wall. The adhesive comprises polymer modified cement. The adhesive is seated between the base wall mount and the respective rear faces of the plurality of wall cladding panels. One or more adhesive spacer parts extend out of the base wall mount in a lateral direction toward the rear faces of the plurality of wall cladding panels to space the rear faces of the plurality of wall cladding panels off of the base wall mount to define an adhesive cavity that contains the adhesive. The base wall mount forms a plate, and further comprising a plurality of wall anchor parts arranged at different angular positions about an axis, of the base wall mount, that is perpendicular to the building wall. The one or more wall anchor parts comprise a fastener, passed through an aperture in the base mount. The panel connector parts each comprise: a base wall mount; and one or more lance parts that extend out of an exterior face of the base wall mount in a lateral direction toward a respective wall cladding panel. The one or more lance parts extend in the lateral direction into the rear face of a respective wall cladding panel, at an interior location, spaced from the side edges, of the respective wall cladding panel. The one or more lance parts penetrate the rear faces of the plurality of wall cladding panels. The one or more lance parts engage the edges of the plurality of wall cladding panels at intermediate locations, spaced from front faces, of each of the plurality of wall cladding panels. The one or more lance parts penetrate the edges of the plurality of wall cladding panels. The panel connector parts engage both abutting edges of adjacent of the plurality of wall cladding panels. Each of the one or more lance parts comprise a one-way fastener part. The panel connector parts each comprise a pull-out restricting tab. The pull-out restricting tab is mounted to pivot relative to the one-way fastener part. The pull-out restricting tab is mounted to pivot by a hinge that defines a leading end of the pull-out restricting tab, which forms a cantilever that is directed one or more of upward, downward, or toward the base wall mount. The pull-out restricting tab defines an internal window in a direction of insertion of the one-way fastener part. The one-way fastener part comprises an insertion tab, and the pull-out restricting tab is cut out or formed from the insertion tab. The one-way fastener part comprises one or more of barbs, shark teeth, and ridges. A plurality of lance parts on each panel connector part. The plurality of lance parts are arranged at different angular positions about an axis, of the base mount, that is perpendicular to the building wall. The base wall mount comprises one or more of a plate, elongate strip, or rail. The one or more lance parts are coated at least in part in adhesive that secures the one or more lance parts to the plurality of wall cladding panels. The panel connector parts are formed out of a sheet of material. The sheet of material is bent to form the panel connector part. The panel connector parts each comprise an insulating backing layer. Wall connector parts are arranged on the rear face of, and at the interior locations, spaced from the side edges, of each of the plurality of wall cladding panels; and in which the wall connector parts interlock with the panel connector parts to mount the plurality of wall cladding panels against the building wall. One or both the wall connector parts and the panel connector parts comprise rails. One or both of the wall connector parts and the panel connector parts comprise clips. One or both of the wall connector parts and the panel connector parts interlock by snap fit. The panel connector parts define a female channel; and the wall connector parts define a male nose that interlocks with the female channel by snap fit. One or both of the wall connector parts and the panel connector parts cooperate to space the rear faces of the plurality of wall cladding panels off of the building wall to define a drainage cavity. The panel connector parts each define a female channel with a channel base that is spaced away from the building wall. The panel connector parts each define drainage passages. The panel connector parts are mounted by fasteners; and axes of the fasteners are offset from the side edges of the plurality of wall cladding panels. The wall connector parts are each anchored within a body of, and spaced from a front face of, the wall cladding panel. The body of each wall cladding panel comprises an exterior insulating layer overlying and secured to an interior insulating layer of the body; and an anchor flange of each wall connector part is sandwiched between the exterior insulating layer and the interior insulating layer. An exterior surface of the interior insulating layer is indented to define a flange cavity within which the anchor flange is seated. The exterior insulating layer and interior insulating layer are adhered together. The side edges of adjacent wall cladding panels overlap with one another. The side edges overlap in tongue and groove relation. The insulating material comprises aerogel. The aerogel comprises silica aerogel. The continuous thermal break layer an R-value of four or greater. The plurality of wall cladding panels comprise a starter row of wall cladding panels mounted on a starter hanger that is secured to the building wall. The starter hanger comprises: a mounting strip secured to the building wall; and a flange that extends laterally off the mounting strip away from the building wall to support a base end of the plurality of wall cladding panels that form the starter row. The flange forms a hook that fits within respective slots in the base ends of the plurality of wall cladding panels that form the starter row. The starter hanger defines a weeping channel. A base flashing strip is mounted below the starter row. The plurality of wall cladding panels are arranged in two or more vertically stacked, horizontal rows. Each of the plurality of wall cladding panels comprise an external decorative finishing layer defining the external face of the wall cladding panel. Assembling the wall cladding system on the building wall. The panel connector parts comprise one or more lance parts that extend out of an exterior face of the base wall mount toward a respective wall cladding panel. The one or more lance parts define a fastener part that defines a leading tip that extends in a lateral direction into the rear face of a respective wall cladding panel, at an interior location, spaced from the edges, of the respective wall cladding panel. The one or more lance parts define a fastener part that defines a leading tip that extends into the edges of the plurality of wall cladding panels at intermediate locations, spaced from front faces, of each of the plurality of wall cladding panels. The one or more lance parts that extend into the edges comprise: a flange that extends out of the exterior face of the base wall mount in a lateral direction; and the fastener part that defines the leading tip that extends one or both of upward or downward from the flange into the edges of the plurality of wall cladding panels. At least some of the panel connector parts engage abutting edges of adjacent of the plurality of wall cladding panels. The leading tips have a triangular shape. The fastener parts comprise one-way fastener parts. The one-way fastener parts each comprise one or more of a pull-out restricting tab, barbs, shark teeth, and ridges. At least some of the panel connector parts are mounted around a corner edge of the building wall. At least some of the panel connector parts that are mounted around the corner edge of the building wall engage the rear faces or side edges of the plurality of wall cladding panels. The plurality of wall cladding panels comprise a starter row of wall cladding panels mounted on a panel connector part that forms a starter hanger and is secured to the building wall. The starter hanger comprises: a mounting strip secured to the building wall; a flange that extends laterally off the mounting strip away from the building wall to support a base end of the plurality of wall cladding panels that form the starter row; one or more lance parts that define fastener parts that each define a leading tip that extends upward from the flange into the edges of the plurality of wall cladding panels of the starter row. The plurality of wall cladding panels comprise a top row of wall cladding panels mounted by a Z-flashing strip that is secured to the building wall. A kit comprising the plurality of wall cladding panels, and the panel connector parts, of the wall cladding system.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIGS. 62-65 are top plan, side elevation, end elevation, and perspective views, respectively, of a mid-clip panel connector part, and FIG. 66 is a blank sheet used to form the mid-clip panel protector part.

FIG. 67 is a top plan view of another embodiment of a mid-clip panel protector part with an insulative backing.

FIGS. 68-72 are top plan, front side elevation, end elevation, rear side elevation, and perspective views, respectively, of a dual lance mid-clip panel connector part.

FIG. 73 is a top plan view of another embodiment of a dual lance mid-clip panel protector part, which is similar to the embodiment of FIG. 68 but with an insulative backing.

In FIG. 92, the outline of abutting wall cladding panels is illustrated with dashed lines.

DETAILED DESCRIPTION

Figure 1:
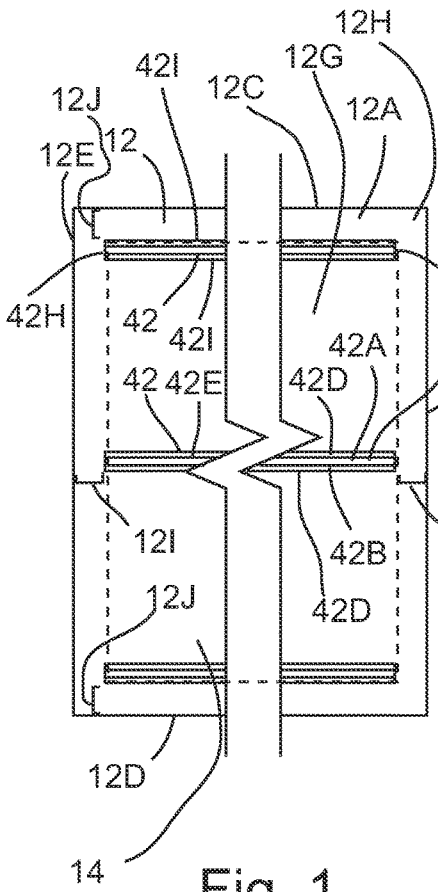
FIG. 1 is a rear elevation view of a wall cladding panel.

Immaterial modifications may be made to the embodiments described here without departing from what is covered by the claims.

In this document, various parts in the description are identified by reference characters, which appear in the drawings to identify the corresponding part or parts. In some cases, suffixes such as ', ", '", or "" are appended to reference characters in the description or drawings to differentiate between like parts. It should be understood that references to parts in the description, whether identified using such suffixes or not, may refer to the same part shown in the drawings, whether suffixes are used in the respective drawing or not.

Cladding refers generally to a layer or layers of material covering another providing a skin or layer. In construction, cladding typically refers to the materials that are applied in layers to the exterior of a building serving to provide a degree of thermal insulation, weather resistance and aesthetic finishing features. Cladding can be constructed using a variety of materials including wood, brick, metal, vinyl, cement blends, aluminum, and others. Broadly, cladding may be used as a control mechanism for varying elements including moisture, noise, heat, fire-resistance, and cold. Various types of barriers and layers may be used in a cladding system.

Insulation may be installed to control the flow of heat (i.e., energy transfer) through the enclosure. Insulation cladding may serve many functions including thermal insulation, acoustic insulation, fire insulation, and impact insulation. Exterior insulation outboard may be installed as a continuous outer layer of a primary structure. Such a method may be more efficient than the traditional method of placing insulation between studs or inboard of the structural frame. A typical installation method may proceed as follows. Damp proofing or a waterproofing membrane may be installed on the exterior side of the foundation wall and footing. Rigid board insulation may be installed on the exterior wall from the top of the footing to the bottom of the cladding. An aluminum coil stock or sheet metal protective cover may be installed for the rigid insulating sheathing. Various types of insulation may be used, such as fiberglass, memory foam, or spray foam insulation.

Improving building insulation values may be considered by many the most effective approach to reducing greenhouse gas emissions. At minimum, such may pay back by lowering energy costs and if properly considered during design, and may also reduce the size of heating and cooling systems required, thus saving additional costs. Such may also "Future Proof" the owner from rising energy costs. In some cases, the panels 12 disclosed here, minimize air leakage, thereby reducing heat loss and air leakage from buildings and thereby reducing carbon emissions. When looking at building envelope parameters to maximize a buildings ability save energy, one must look at the conduction, solar radiation and air infiltration. Conduction relates to the buildings ability to conduct or resist heat flow. Solar radiation relates to wanted heat gains through windows. Infiltration relates to the air leakage through the building envelope. Such are all important considerations for new construction or the retrofit market.

Figure 2:
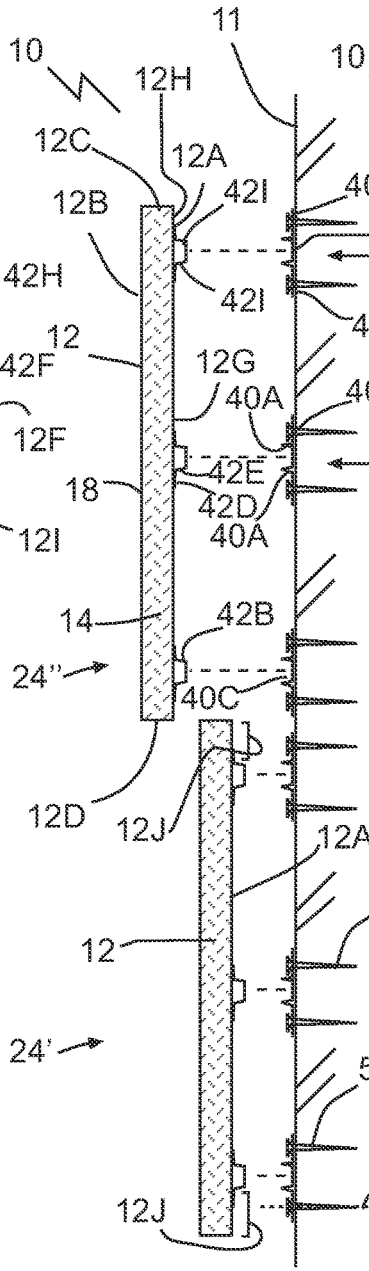
FIGS. 2 and 3 are exploded and non-exploded, respectively, cross sectional views of an embodiment of a wall cladding panel system on a building.
Figure 3:
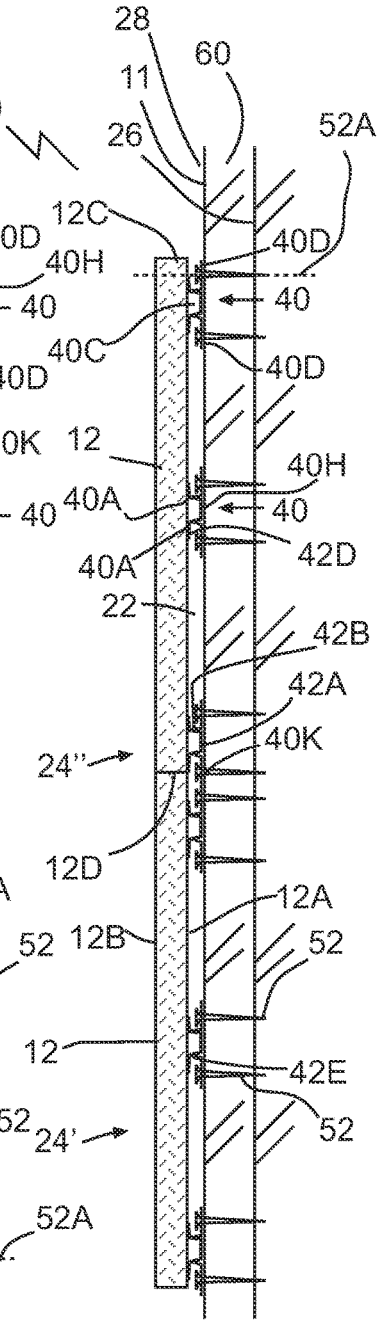

Referring to FIGS. 1-3, a wall cladding plank or panel 12, and a wall cladding panel system 10 are illustrated. Each of panel 12 and system 10 will be described, and should be understood as each forming parts of this disclosure that may be used independent of each other, or in combination, without limiting the claims that may be made to one or more such parts.

Figures 7, 8, 9:
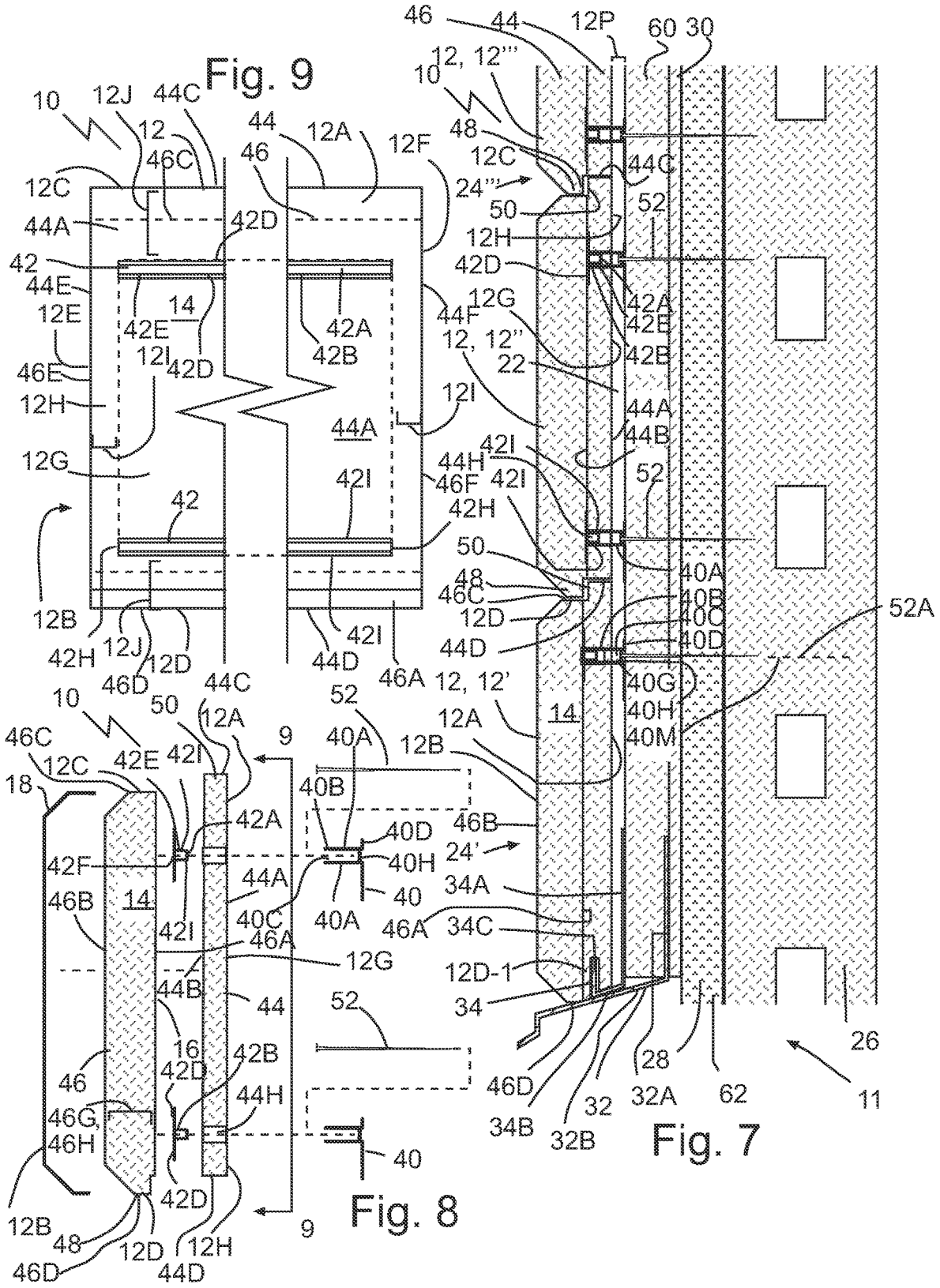
FIG. 7 is a cross sectional view of the wall cladding panel system of FIG. 4 installed on a building wall.
FIG. 8 is an exploded vertical cross-sectional view of a wall cladding panel, wall and wall connector rails, and fasteners, from the system of FIG. 7.
FIG. 9 is a rear elevation view of the wall cladding panel from FIG. 8.

Referring to FIGS. 1-3 and 7-8, a wall cladding panel 12 is illustrated. Panel 12 may be structured for mounting to a building wall 11, alone or in combination with other panels 12. The panel 12 may be pre-fabricated. Panel 12 may comprise a core 14 of insulating material. More generally, each panel 12 may comprise a layer of insulating material. Each panel 12 may define an external face 12B, a rear face 12A, and side edges 12C-F, with adjacent of the wall cladding panels 12 abutting one another in use along respective side edges 12C-F. Panel 12 may have a fire-resistant component, such as a fire-resistant layer 16 (FIG. 8). Panel 12 may be configured to interlock with adjacent panels 12, such as by having a corresponding tongue 48 and groove 50 profiles on opposing edges, such as top and bottom edges 12C and 12D, respectively, of the pre-fabricated wall cladding panel 12. In use, each panel 12 may mate with one or more adjacent pre-fabricated wall cladding panels of identical or similar dimensions. Panel 12 may have or define a drainage system 22, which may be defined at least in part on or by a rear face 12A of the panel 12. Panel 12 may have an external decorative finishing layer 18, for example a layer that simulates a wood, metal, or other desired finish.

Referring to FIG. 7, a wall cladding system 10 is illustrated, formed of a building wall 11, a plurality of wall cladding panels 12, and panel connector parts 40. Each panel connector part 42 may cooperate to mount the plurality of wall cladding panels 12 as a continuous thermal break layer against the building wall 11. The panel connector part 42 may also act to secure a first layer 60 of insulating material against a wall frame, such as outer sheathing (such as oriented strand board, or OSB layer 62) or studs 26, and to secure a second layer 44 or layers, such as layers 44 and 46, of insulating material (core 14 of panel 12) against the wall 11. The part 42 may act as a fastener and washer to hold the first layer 60 against the wall. In addition to a dual insulating layer mounting system, the panel connector parts 40 may space or separate the dual insulating layers to define a drainage system 22 in between. In some cases, the parts 40 mount a layer 44 of insulating material against the wall frame, such as OSB layer 62 or studs 26. In use, panel connector parts 40 may be mounted on the building wall 11 and engage the rear faces 12A of the plurality of wall cladding panels 12 at interior locations, spaced from the side edges 12C-F, of each of the plurality of wall cladding panels 12, to mount the plurality of wall cladding panels 12 as a continuous thermal break layer against the building wall 11. A thermal break or thermal barrier may refer to the system 10 providing a continuous layer of relatively low thermal conductivity placed in an assembly to reduce or prevent the flow of thermal energy between conductive materials. The opposite of a thermal barrier is a thermal bridge, which may often be formed in wall cladding systems across metal brackets and fasteners that extend from stud to at or near the exterior of the cladding. By providing a layer of panels 12, whose edges abut one another without fasteners, hangers, or brackets extending therethrough, a continuous insulating layer is produced for minimal thermal losses.

Referring to FIGS. 1-3 and 7-9, the system 10, for example panels 12, may incorporate wall connector parts 42. Wall connector parts 42 may be arranged on the rear face 12A of, and at interior locations, spaced from the side edges 12C-F, of each of the plurality of wall cladding panels 12. The wall connector parts 42 may cooperate with the panel connector parts 40 mounted on the building wall 11. The wall connector parts 42 and the panel connector parts 40 may interlock to permit the panel connector parts 40 to engage the rear faces indirectly, and to mount the plurality of wall cladding panels 12 as a continuous thermal break layer against the building wall 11.

Referring to FIGS. 1 and 9, the placement of parts 42 and/or the engagement of rear face 12A of panel 12 at interior locations may refer to the fact that the parts 42 are positioned in an interior fascia portion 12G of rear face 12A, as opposed to a peripheral fascia portion 12H of the face 12A. The peripheral fascia portion 12H may separate the interior fascia portion 12G from the side edges 12C-F of the panel 12 a suitable distance, such as distances 12I between axial edges 42H of parts 42 and edges 12E and 12F of panels 12, and/or distances 12J between lateral edges 42I of parts 42 and edges 12C and 12D or panels 12, to minimize or remove thermal bridging across abutting edges of adjacent panels 12. The separation distances 12I and 12J may be selected to be one inch or greater or less, depending on context. By engaging only the rear face 12A of the panel away from the edges 12C-F of the panel 12, a continuous thermal break is provided around the peripheral edges of the panel 12, avoiding the thermal bridging that occurs through pressure caps, mounting brackets, and/or fasteners that extend from the exterior surface of a cladding system to the studs 26 in conventional cladding systems.

Referring to FIGS. 1-3, a method of assembling a wall cladding system 10 is illustrated. A plurality of panel connector parts 40 may be mounted along a building wall 11, for example using a plurality of fasteners 52. A plurality of wall cladding panels 12 may be positioned along an exterior of the building wall 11, such as against an insulating layer 60, or against a drywall layer 28. The building wall may thus comprise an insulating layer 60 overlying one or more of a sheathing or layer of studs 26, and the panel connector parts 40 may mount the insulating layer 60 to the one or more of the sheathing or studs 26 via fasteners 52. The panels 12 may or may not have wall connector parts 42. The panels 12 are then mounted to the wall 11 via the panel connector parts 40. In some cases, the panel and wall connector parts 40, 42 are interlocked to mount the plurality of wall cladding panels 12 as a continuous thermal break layer against the building wall 11.

Referring to FIGS. 1-3 and 7-8, the panel and wall connector parts 40, 42 may take suitable forms. One or both the panel and wall connector parts 40, 42 may comprise rails as shown. A rail may comprise an elongate body, for example made of sufficient length to extend from one end of the interior fascia portion 12G to the opposite end of the interior fascia portion 12G on an insulated wall panel 12. The elongate body may be extruded, for example with consistent cross-sectional shapes along a respective longitudinal axis of the body or cap, for example from one axial end 42H to an opposite axial end 42H of the body or cap. One or both of the panel and wall connector parts 40, 42 may comprise clips. A rail may be a clip and vice versa. A clip system may incorporate relatively short, discrete, independent connector parts as opposed to an elongate bodied rail system. Other mechanisms may be used.

Referring to FIGS. 1-3 and 7-8, one or both of the panel and wall connector parts 40, 42 may interlock by snap fit. A snap-fit includes an assembly method used to attach flexible parts, usually plastic, to form the final product by pushing the parts' interlocking components together. There are a number of variations in snap-fits, including cantilever, torsional and annular. Snap-fits may include integral attachment features, may be an alternative to assembly using fasteners such as nails or screws, and may have the advantages of speed and no loose parts.

Referring to FIGS. 1-3 and 7-8, various styles of snap-fits may be used. The panel connector parts 40 may define a female channel 40C. The wall connector parts 42 may define a male nose 42A that interlocks with the female channel 40C. The channel 40C may be defined by opposed walls 40A spaced by a web or base mount 40H. The base mount 40H may have one or more side flanges 40D extended laterally from one or both sides. The nose 42A may be formed by side walls 42E that extend from a web or base mount 42F. The base mount 42F may have one or more side flanges 42D extended laterally from one or both sides.

Referring to FIGS. 2-3 and 7-8, fasteners 52 may mount the panel connector parts 40, for example by securing one or both side flanges 40D (shown in FIGS. 2-3) or base mount 40H (FIGS. 7-8). Referring to FIGS. 7-8, fasteners 52 may pass through one or more fastener slots or apertures 40K. Each aperture may be an elongate slot to accommodate insertion into a respective stud 26. Referring to FIGS. 2-3 and 7-8, respective axes 52A of the fasteners 52 may be offset from the side edges 12C-F of the plurality of wall cladding panels 12. Fasteners 52 are a common form of thermal bridge in conventional cladding systems 10, and in various embodiments disclosed here, the fasteners 52 are offset from the edges of the panels to provide a thermal break.

Referring to FIGS. 4-8, the panel and wall connector parts 40, 42 may have suitable features. The walls 40A of panel connector parts 40 may have locking tabs 40B, which may cooperate with locking tabs 42B on wall connector parts 42. The nose 42A may be solid or hollow (shown), for example forming a hollow internal cavity 42G. The wall connector part 40 may form a pressure cap, and the panel connector part 42 may form a cap receiver. The base mount 40H of panel connector part 40 may be spaced from the building wall 11 in use, for example spaced from a wall plane defined by flanges 40D, for example using legs 40J to define a separation distance 40I. Each flange 40D may be a different length, for example the part 40 may have a long flange 40D-2 and a relatively short flange 40D-1. The long flange 40D-2 or both flanges may have fastener indents or slots 40D-2A. Flanges 42D may have similar features. The parts 40 and 42 may have suitable shapes. In the example shown the walls 40A and web base mount 40H may form a C-channel beam or column. Other shapes may be used such as that of an I-beam or an arcuate trough. Although female tabs or locks are shown on parts 40 and male ones on parts 42, such may be reversed or gender-neutral tabs or locks may be used on one or both parts.

Figures 4, 5, 6:
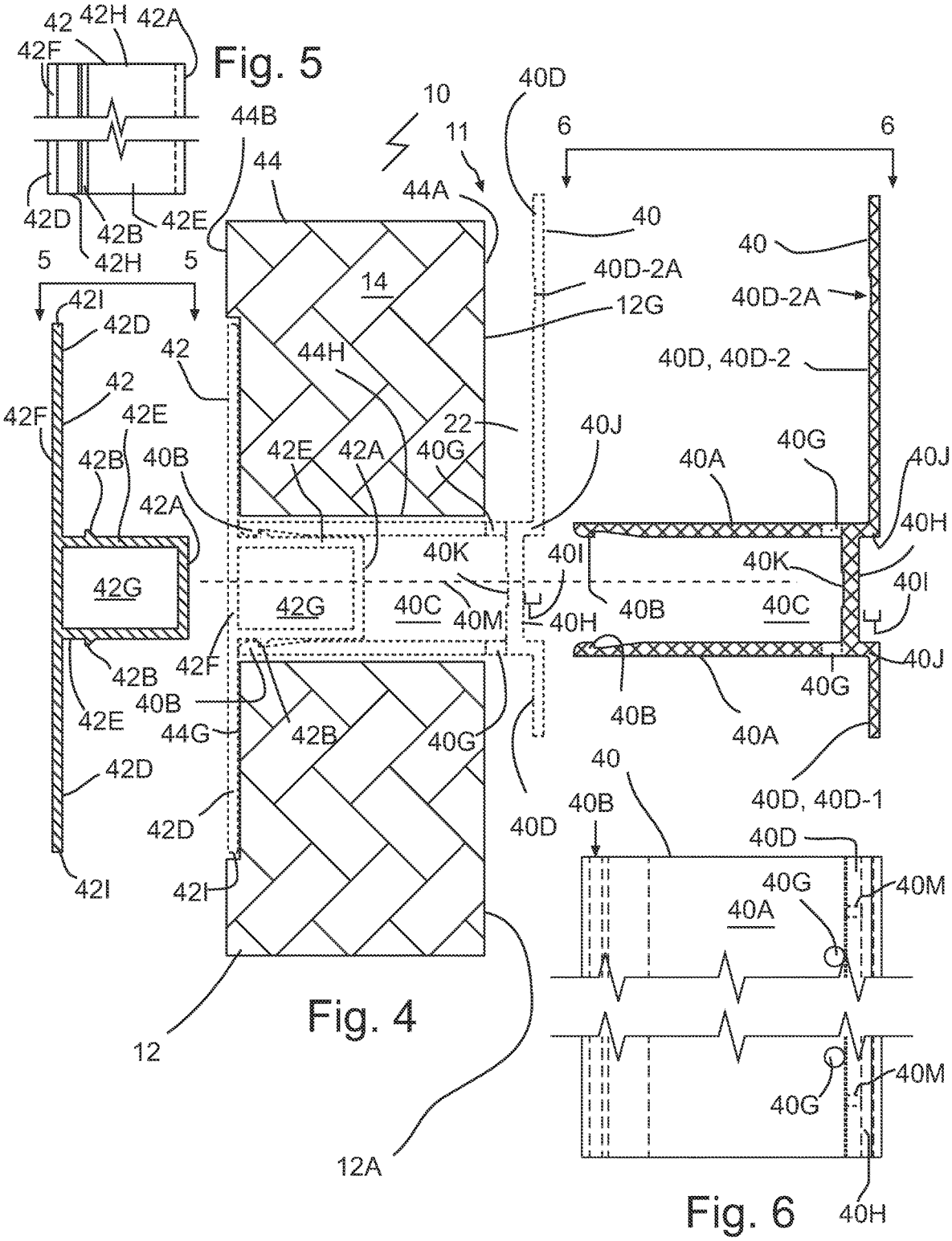
FIG. 4 is a vertical cross-sectional view of a part of another embodiment of a wall cladding panel system, incorporating wall and panel connecter rails, with the rails shown in an exploded configuration in solid lines and an installed configuration in dashed lines.
FIG. 5 is a side elevation view of the wall connector rails of FIG. 4.
FIG. 6 is a side elevation view of the panel connector rails of FIG. 4.

Referring to FIGS. 4-8, the wall connector parts 42 may be each anchored within a body (core 14) of, and spaced from a front face 12B of, the wall cladding panel 12. Referring to FIG. 4, an exterior surface, such as front face 44B of an interior insulating layer 44 of panel 12 may be indented to define a flange cavity or slot 44G within which sits the anchor flange 42D of part 42. Referring to FIGS. 7-8, the body or core 14 of each wall cladding panel 12 may comprise an exterior insulating layer 46 overlying and secured to an interior insulating layer 44. The anchor flanges 42D of each wall connector part 42 may be sandwiched between the exterior insulating layer 46 and the interior insulating layer 44. The exterior insulating layer 46 and interior insulating layer 44 may be adhered together. The noses 42A may pass through and be positioned within respective plug or panel connector part passages 44H in the interior insulation layer 44. In the example shown, the anchor flanges 42D mount on a front face 44B of layer 44, while the nose 42A extends partially into the passage 44H, which extends from front face 44B to a rear face 44A of layer 44. Edges 44C-F of layer 44 may define side edges 12C-F, respectively, of panel 12. The rear face 46A of the exterior layer 46 may contact and secure anchor flange 42D within slot 44G, with a front face 46B of layer 46 defining the front face 12A of the panel 12, and side edges 46C-F defining side edges 12C-F, respectively, of panel 12. The use of layer 46 may separate the wall connector part 40 from the front face 12A by a distance 46G sufficient to provide a thermal break. The plurality of parts 40, 42 may form a network of columns and beams that extend along the rear faces 12A of the wall cladding panels 112. The cap receivers/parts 40 and pressure caps/parts 42 may interlock via a suitable method such as an interference fit, a snap fit, a friction fit, a latch, or other mechanisms.

A rainscreen may be an exterior wall detail where the siding (wall cladding) stands off from the moisture-resistant surface of an air barrier applied to the sheathing (sheeting) to create a capillary break and to allow drainage and evaporation. The rainscreen may be considered the siding itself, although the term rainscreen may imply a system of building. Ideally the rain screen prevents the wall air/moisture barrier on sheathing from getting wet. In some cases, a rainscreen wall is called a pressure-equalized rainscreen wall where the ventilation openings are large enough for the air pressure to nearly equalize on both sides of the rain screen.

Referring to FIG. 7 a water resistive barrier (WRB—such as membrane 30), may be installed inboard of the cladding as a secondary barrier to moisture to prevent water ingress, and to create a drainage gap between the cladding and WRB to allow drainage of water which penetrates past the cladding. Such an approach may be referred to as a rainscreen wall assembly. Rainscreen cladding is a detail attached to the exterior of a building wall to create a capillary break allowing for drainage and evaporation. A rainscreen may provide a weather barrier and prevent water from penetrating the cladding. A rainscreen may not need to be waterproof, as it may serve as a control mechanism for diverting water from the exterior wall. Ideally, a rainscreen functions to prevent the air and moisture barrier or wall sheathing from getting wet. A rainscreen may achieve such function first by means of directing the water away from the main exterior wall, preventing it from penetrating the cladding. A rainscreen may also provide a mechanism for the drainage of any water that has leaked into the system. A water or air resistant membrane may be situated between the sheathing and furring to prevent water from entering, and may direct water toward a special drip edge flashing. If the rainscreen proves effective, the structural frame and thermal insulation of the building remains dry and optimally functional.

An air barrier, such as is also provided by membrane 30 in the example shown, may be configured to control bulk air movement through the wall. A vapor barrier or membrane 30 may be installed to control diffusion of water vapor through the wall assembly. An impermeable material may be used for this function. An air barrier system may be used generally to control the flow of air into and out of a building. Control of such airflows may be important to limit energy loss due to exfiltration, to reduce the potential for air leakage and associated condensation, for occupant comfort, and for indoor air quality.

Referring to FIGS. 3 and 8, the panels 12 may define or otherwise provide a rainscreen. One or both of the panel and wall connector parts 40, 42, may cooperate to space the rear faces 12A of the plurality of wall cladding panels 12 off of the building wall 11 to define a drainage system 22. For example, one or more of the walls 42A 42E, or tabs 40B, 42B, may be structured, for example sized, to define a suitable drainage cavity 12P depth or distance. A drainage cavity 12P permits water to drain behind the panels 12, and out of the system 10, to avoid water damage. Referring to FIGS. 4 and 6, the panel connector parts 40 may each define drainage passages 40G. The passages 40G and cavity 12P may cooperate to form a comprehensive cavity.

In some cases, the panels 12 themselves may be structured to define drainage channels (not shown). For example, channels may be defined in rear or internal faces 12A of the panels 12. The channels may be oriented vertically or in other arrangements such that the channels convey moisture vertically to drain out of the wall system 10. In some cases, the channels communicate fluidly with vents to provide a self-draining, pressure-equalized rainscreen or panel. Continuous air flow may be permitted between the top and bottom panels 12 in the system, and to drain out any possible infiltrating water. Each panel 12 may incorporate an integral drainage system 22. The integral drainage system may comprise one or more drainage grooves contoured in the rear faces 12A of the panels 12. Drainage grooves may run in one or more of overlapping curves or grooves, vertical lines, or lines angled between horizontal and vertical. In some cases, passages are contoured within the panel 12 itself, for example holes may be drilled directly through each panel 12.

Referring to FIGS. 1-3 and 7-8, a wall cladding system 10 may be constructed using a plurality of panels 12. In use panels 12 may be situated in rows 24 either vertically, horizontally, or both. In the example shown panels 12 are arranged in rows, such as vertically stacked, horizontal rows 24. Panels 12 may come in a variety of shapes and sizes. Wall cladding slats or panels 12 may be made of a variety of different materials including wood, aluminum, and plastic. Panels may be hung or attached individually, or they may be attached to one another using an interlocking system where adjacent panels interlock with one another.

In use, the system 10 may be assembled upon a building wall 11, for example in a network or grid. Panel connector parts 40 and wall cladding panels 12 may be arranged on a wall 11. The panel connector parts 40 may be secured to the wall 11 before, during, or after install of panels 12. In some cases, a method is carried out where a series of panel connector parts 40 are secured to wall 11, a row 24 of panels 12 is arranged on the wall 11 on the panel connector parts 40, and a second series of panel connector parts 40 and panels 12 are secured above the previously installed panels 12, to secure and assemble the system 10 one row of panels at a time.

Referring to FIGS. 1-3 and 7-8, the panel 12 may be a plank. A plank or slab shape refers to a shape where an encircling wall, such as defined collectively by end edges 12E, 12F, and top and bottom edges 12C, 12D, define a separation distance between rear and front faces 12A, 12B, respectively, the separation being relatively thin compared to the maximum or local maximum lateral dimensions of the faces 12A/12B, such as the length and width dimensions in the case of a rectangular plank. A plank may also refer to a relatively thin, long flat item or sheet, and in some cases a thin square or rectangular sheet. Some or all of the external edges and corners of the external surfaces of a plank may be rounded or beveled for ease of handling. A plank may also include a rectangular box or rectangular cuboid, and other terms such as a slate, sheet, bar, tablet, and cell phone, may be used to describe the shape of the panel 12. Faces 12A and 12B are shown as rectangular, but may have non-rectangular shapes such as circular, oval, polygonal, or other shapes. The rectangular panel shape shown has a low profile, which may be advantageous for storage and installation.

Prefabrication may mean that the panel 12 is assembled or otherwise constructed at a location remote from the building site or wall 11, in some cases five, ten, or more kilometers away, for example at a distance sufficient to warrant machine transport of the panel 12 to the building site as the only practical method of transporting the panel 12 to the building site. A building site is a location where a building is situated or being constructed, for example containing one or more walls 11, whether internal or exterior walls.

Referring to FIGS. 1-3 and 7-8, in the example shown, the panel 12 may be constructed by a suitable method. Core 14 may be molded or pressed to create a tongue and groove design. Plural insulating layers 44 and 46 may be laminated or otherwise adhered together. Core 14 may be wrapped with a fiberglass reinforced mess and polymer modified cement, for example forming layer 16. A further coat or coats may then be applied with a sandable micro cement. The panel 12 may then be sanded, primed and paint to apply layer 18 and achieve an ultra-smooth look, metal like appearance, or any other desired appearance.

Referring to FIG. 7, the building wall 11 may incorporate various suitable parts, such as, in sequence from exterior to interior, a rainscreen/weather resistant barrier/vapor barrier membrane 30, a drywall layer 28 and/or external sheathing layer 62, and a plurality of wall studs 26, such as metal or wood studs. The wall connector parts 42 may secure to a suitable location on wall 11, such as to the studs 26. Drywall layer 28 is an example of an inner sheathing member of a wall, the member being affixed to studs 26 or other supports. Other sheathing members may be used, such as plywood board, insulated concrete, insulation layers 60, a composite board, or any other material permitted by local building codes.

Referring to FIGS. 7-8, each panel 12 may be structured to interlock with adjacent panels 12, for example the side edges of adjacent wall cladding panels 12 may overlap with one another. The side edges of the panels 12 may overlap in tongue and groove relation. Panels 12 may use a joint system to interconnect. Panels 12, sometimes referred to as planks, may be secured together using some type of joint, such as a tongue and groove joint (shown), a shiplap joint, and "wet" or "dry" joints. Wet joint systems employ backer rod and sealant to provide water protection, while dry joint systems may employ a rainscreen system. In drier climates, a wet joint may be preferred, while in more moist climates a dry joint may be preferred. A lap joint or overlap joint is a joint in which the members overlap. A lap joint may be a full lap or half lap.

Referring to FIGS. 7-8, each panel 12 may be structured to interlock with adjacent panels 12 via a tongue 48 and groove 50 system. The design of the tongue and groove fastening system of the panels 12 shown incorporates a thermal break, thus reducing or eliminating negative heat conduction effects from metal fasteners that conduct temperature variations, or other thermal breaks. In some cases, the panels 12 may be structured to cooperate together to create a continuous insulated tongue and groove design that allows the system to retain its thermal breaks at lapped sections, providing a continuous thermal break across plural, in some case all, rows 24 of panels 12 arranged on a wall 11.

Referring to FIGS. 7-8, the interlocking connection parts, such as tongue 48 and groove 50, may be located on suitable locations on each panel 12. In the example shown the corresponding tongue 48 and groove 50 profiles of each wall cladding panel 12 are located on opposing bottom and top edges 12D, 12C, respectively, of each of the plurality of wall cladding panels 12. When panels 12 are arranged in rows 24 as shown, adjacent rows above and below one another connect by interlocking the respective corresponding tongue 48 and groove 50 profiles of the wall cladding panels 12 of each of the adjacent rows 24. For example, grooves 50 of panels 12 of row 24' may interlock with tongues 48 of panels 12 of row 24", and so on. Tongues 48 may be located on top edges 12C, with grooves 50 of bottom edges 12D, or vice versa. In some cases, an edge of panel 12 may have both a tongue and a groove. An interlocking profile may permit adjacent wall cladding panels of identical dimensions to mate with one another.

Referring to FIGS. 7-9, in some cases (not shown) side or end edges 12E, 12F may incorporate joints, such as tongue and groove profiles, for mating and interlocking with laterally adjacent panels 12 of the same row 24. For example, a shiplap or lap joint may be used, incorporating a tongue and shoulder on one panel 12, which mates with a corresponding groove 50 and ledge on another panel 12.

Referring to FIG. 7, the installation of system 10 assembly may begin with or a suitable position in sequence involve, the application of a base flashing 32, which may be made of a suitable material such as metal. Flashing 32 may be levelled and fastened (for example using fasteners) at or near the base or other suitable portion of an exterior wall 11. Flashing 32 may be formed by a mounting strip 32A that mounts to wall 11 and runs laterally across the face of the wall 11. A base flange 32B may extend laterally off the wall 11 from strip 32A. In the example shown flange 32B is sloped downward with increasing distance from wall 11, to direct fluids downward and away from wall 11 during draining. In some cases, flashing 32 may omit the flange 32B. Other suitable structures of flashing 32 may be used, including a continuous strip as shown or discontinuous (discrete) strips.

Referring to FIG. 7, the plurality of wall cladding panels 12 may be arranged in a starter row 24' of wall cladding panels 12. The row 24' of panels 12 may be mounted on a starter hanger, such as a start or mounting strip 34A, that is secured to the building wall 11. In the example shown the strip 34A mounts over flashing 32, and both are secured together and to the wall 11 by fasteners (not shown). The starter hanger may have a suitable structure, including a continuous strip 34A as shown, or a series of discontinuous, discrete strips at intervals from one another. The hanger 34 may comprise a flange 34B that extends laterally off the mounting strip 34A away from the building wall 11 to support a base end (edges 12D) of the plurality of wall cladding panels 12 that form the starter row 24'.

Referring to FIG. 7, in some cases the hanger 34 may engage the panels 12, for example the flange 34B may form a hook (such as a panel base receiver 34C) for the panel 12'. The hook may fit within a respective slot 12D-1 in the base ends or edges 12D of the plurality of wall cladding panels 12 that form the starter row 24'. The starter hanger 34 may comprise a plurality of weeping holes (not shown) for drainage. Weep holes may be spaced at suitable intervals, such as twelve inches on center (o.c) to allow for possible water intrusion to exit the system. The rear flange or mounting strip 34A may slide horizontally interlocking itself level with the base of wall flashing 32. After the installation of the starter strip 34A a primer adhered membrane may be installed to cover any fastener holes and laps onto the wall, for example six inches past the top of the starter/flashing flange.

Referring to FIG. 7, before or after the flashing 32 and starter hanger 34 are in place, weatherproofing may be applied. Weather proofing may be in the form of a vapor-permeable membrane 30, air barrier or water proofing membrane as specified, depending on the wall assembly. Once the wall is weather proofed the starter panel the remaining panels 12 may be installed.

Referring to FIG. 7 suitable starter panels 12 may be used for the starter row 24'. The starter panel 12 may be slightly different at the base from the panels 12 of other rows 24. Such difference may be to allow for a tight, snug interlock with the starter hanger 34. Once the panels 12 have been slid into place, such panels 12 may be fastened to the wall studs 26 at suitable intervals, such as sixteen inches o.c., using a spacer/fastening system such as panel connector parts 40.

Referring to FIG. 7, once the starter row 24' is in place, subsequent rows 24 may be added to the system 10. Each panel 12 may be secured to wall 11 one row 24 at a time. Once a row 24 is secured, a further row 24 may be added, for example by interlocking the adjacent rows 24, followed by securing the upper row 24. Using a continuous tongue and groove design as shown may eliminate any thermal bridging a typical exposed fastener panel design would otherwise experience. In some cases, no fasteners are visible form the exterior of a finished system 10.

The system 10 may reduce or eliminate the amounts of fasteners and washers that may otherwise be used to hold a mineral wool, z-girth application, thus reducing potential air and water leakage. The system may incorporate one or more of non-combustible, highly insulating, low profile (slim and lightweight) paneling, a fastening/rainscreen system, and an easy and quick application process, thus forming a cost-effective architectural panel.

As the disclosed method shows a prefabricated system, quality may be consistent and installation time may be up to one third the time to install than current exterior cladding systems. Being a relatively slim product may make the installation and storage of panels 12 easier than competitive products, but over and above allows the user to leverage higher R-values than competitors with less material. Various modifications may be made to accommodate panels 12 around the corners, windows, doors, or other access points of a building.

Referring to FIGS. 14-22 and 24, a wall cladding panel 12 may be configured to provide a finished, aesthetically pleasing exterior surface that adds curb appeal to the building. A suitable coating may be painted, coated, laminated, or applied in another suitable manner to the exterior of the cladding. The outer core layer 16 may comprise alkaline resistant reinforcing mesh and a polymer modified cement, with the finished product being made to emulate composite metal panel systems at half the cost, along with a metal look, by applying an appropriate finishing layer 18. Suitable layers 18 may include materials that appear similar to or identical with natural materials such as stone, granite, and glass. In some cases, the external decorative finishing layer comprises a paint coating or a laminate layer.

Each panel 12 may be structured to mount an external panel (not shown). An external panel may be clipped on to the external decorative finishing layer 18. A lock or locking system, such as the use of fasteners or latches, may be used to secure the external panel to the panel 12 or groups of panels 12 (not shown). Quick release, clipping, friction fit, interference fits, and other mechanisms may be used. The use of an external panel interconnection system permits the external appearance of the building to be easily tailored, by selecting one of a variety of suitable exterior facades. For example, the external panel may comprise one or more of a glass panel, a lighting panel, a perforated metal decorative panel, and a solar panel.

A wall cladding system may be configured to provide fire retardant characteristics. Many fire-resistant exterior walls are clad in fire-resistant materials such as stucco, brick or concrete. A wall that is clad in less fire-resistant materials such as vinyl or wood siding may also use fire-resistant wallboard or other materials to supplement fire retardancy. Slentex™ may be used to provide a non-flammable material. Such material may be a Silica Aerogel technology that gets away from petroleum based plastic technologies to further reduce pressure on greenhouse gas emissions. Slentex™ is the lightest non-combustible, non-petroleum base insulation on the market making it preferential over a mineral wool or standard foam product. Two aerogel-based high-performance insulating materials are SLENTITE™ and SLENTEX™. However, a suitable fire-resistant component such as layer 16, may comprise fiberglass and poly-cement.

The components of the panel 12 may include a core 14, currently made of 2.5" thick thus giving the panels a R18.25 R-value. Slentex™ may provide the first silica aerogel insulation, and may be molded to specifications. Other compounds may be used, such as one or more of mineral wool, expanded polystyrene, and silica aerogel.

The panels 12 may be manufactured in a suitable thickness, such as thicknesses up to 4" or larger potentially giving the panel an R value of 29.2 thus exceeding current building codes with exterior insulating not including interior insulation. By contrast, a panel with an R Value of 3.3 it would take nearly 9" of mineral wool to achieve the same R value. In some cases, the core 14 has an R-value of 10 or higher. An insulating material may have an R value of 4 or more.

The insulating panel 12 or any of the layers 44, 46, 60 or others of insulating material may comprise a suitable insulating core such as aerogel. The aerogel may comprise a silica aerogel. The insulating panel 12 may be structured to have an R-value of four or greater, for example 10 or greater. In some cases, the panel 12 has at least an R-value of three or greater, for example 3.5. With silica aerogel, R-values of four are possible with a 10 mm thickness. Aerogel may have an insulating density of four or more per centimeter. In some cases, the panels 12 are used for residential or commercial buildings.

An aerogel is an insulating, lightweight component. An aerogel may be produced by extracting the liquid component of a gel through supercritical drying. This allows the liquid to be slowly dried off without causing the solid matrix in the gel to collapse from capillary action, as would happen with conventional evaporation. The first aerogels were produced from silica gels. Kistler's later work involved aerogels based on alumina, chromia and tin dioxide. Carbon aerogels were first developed in the late 1980s. Aerogel is not a single material with a set chemical formula, instead, the term is used to group all materials with a certain geometric structure. Despite the name, aerogels may be solid, rigid, and dry materials that do not resemble a gel in their physical properties. The name aerogel comes from the fact that the material is made from a gel.

Pressing softly on an aerogel typically does not leave even a minor mark, pressing more firmly will leave a permanent depression. Pressing extremely firmly may cause a catastrophic breakdown in the sparse structure, causing it to shatter like glass (a property known as friability), although more modern variations do not suffer from this. Despite the fact that it is prone to shattering, an aerogel may be very strong structurally. Its impressive load-bearing abilities may be due to the dendritic microstructure, in which spherical particles of average size 2-5 nm are fused together into clusters. These clusters may form a three-dimensional highly porous structure of almost fractal chains, with pores just under 100 nm. The average size and density of the pores can be controlled during the manufacturing process.

An aerogel is a material that may be 99.8% air or more or less. Aerogels may have a porous solid network that contains air pockets, with the air pockets taking up the majority of space within the material. The lack of solid material allows aerogel to be almost weightless. Aerogels may be good thermal insulators because they almost nullify two of the three methods of heat transfer—conduction (they are mostly composed of insulating gas) and convection (the microstructure prevents net gas movement). They are good conductive insulators because they are composed almost entirely of gases, which are very poor heat conductors. Silica aerogel is an especially good insulator because silica is also a poor conductor of heat—a metallic or carbon aerogel, on the other hand, would be less effective. Aerogels may be good convective inhibitors because air cannot circulate through the lattice. Aerogels may be poor radiative insulators because infrared radiation (which transfers heat) passes through them.

Silica aerogel may be used. Silica aerogel is silica-based and may be derived from silica gel or by a modified Stober process. A low-density silica nanofoam may weigh 1,000 g/m3, which is the evacuated version of the record-aerogel of 1,900 g/m3. By contrast, the density of air is 1,200 g/m3 (at 20° C. and 1 atm). The silica may solidify into three-dimensional, intertwined clusters that make up about 3% of the volume. Conduction through the solid may therefore be very low. The remaining 97% of the volume may be composed of air in extremely small nanopores. The air has little room to move, inhibiting both convection and gas-phase conduction. Silica aerogel may have a high optical transmission of ~99% and a low refractive index of ~1.05. Silica aerogel may have remarkable thermal insulating properties, having an extremely low thermal conductivity: from 0.03 W/(m·K) in atmospheric pressure down to 0.004 W/(m·K) in modest vacuum, which correspond to R-values of 14 to 105 (US customary) or 3.0 to 22.2 (metric) for 3.5 in (89 mm) thickness. For comparison, typical wall insulation is 13 (US customary) or 2.7 (metric) for the same thickness. SLENTEX™ material may be used. SLENTEX™ is a super hydrophobic product that may seal-seal to a penetrating fastener sufficient to keep water out of the formed fastener bore without the use of adhesive being required (although adhesive may still be used for extra strength).

Carbon aerogels may be used. Carbon aerogel may be composed of particles with sizes in the nanometer range, covalently bonded together. They have very high porosity (over 50%, with pore diameter under 100 nm) and surface areas ranging between 400-1,000 m2/g. They may be manufactured as composite paper: non-woven paper made of carbon fibers, impregnated with resorcinol-formaldehyde aerogel, and pyrolyzed. Depending on the density, carbon aerogels may be electrically conductive, making composite aerogel paper useful for electrodes in capacitors or deionization electrodes. Carbon aerogels may be extremely "black" in the infrared spectrum, reflecting only 0.3% of radiation between 250 nm and 14.3 μm, making them efficient for solar energy collectors.

Other insulating materials may be used. Metal oxide aerogels may be used. Aerogels made with aluminum oxide are known as alumina aerogels. These aerogels are used as catalysts, especially when "doped" with a metal other than aluminum. Nickel-alumina aerogel is the most common combination. Aero graphite or aero graphene may be used. Organic polymers may be used to create aerogels. SEAgel™ is made of agar. Cellulose from plants may be used to create a flexible aerogel. Chalcogel™ is an aerogel made of chalcogens (the column of elements on the periodic table beginning with oxygen) such as sulfur, selenium and other elements—metals less expensive than platinum have been used in its creation. Aerogels made of cadmium selenide quantum dots in a porous 3-D network or other arrangement may be used Aerogel performance may be augmented for a specific application by the addition of dopants, reinforcing structures and hybridizing compounds.

Figure 10:
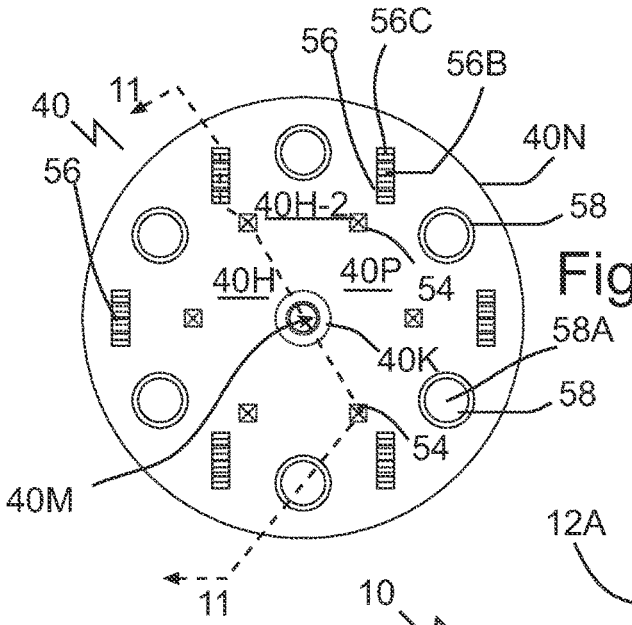
FIG. 10 is a front elevation view of a panel connector part that operates as a panel gripper plate.
Figure 11:
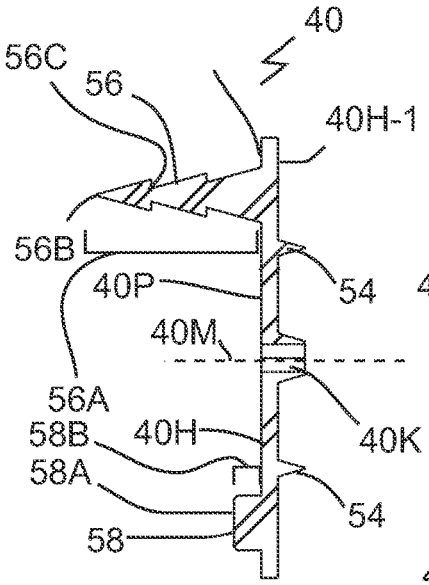
FIG. 11 is a cross sectional view taken along the 11-11 section lines of FIG. 10.
Figure 12:
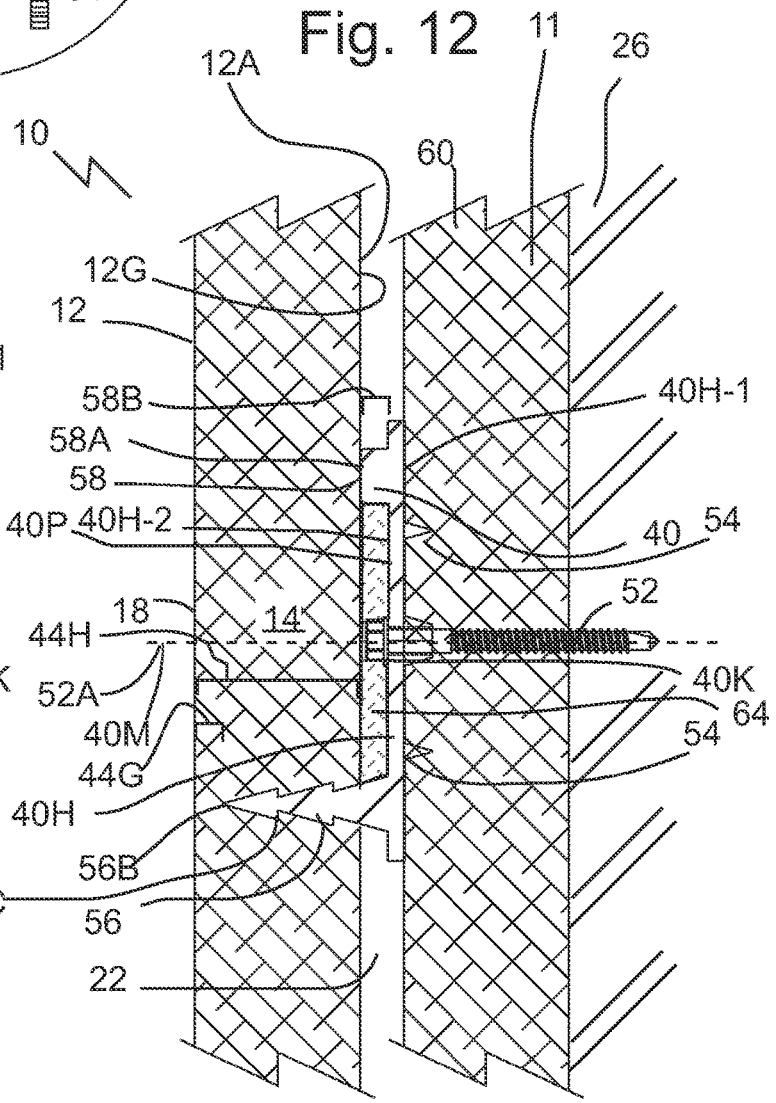
FIG. 12 is a cross section view, illustrating the panel gripper plate of FIG. 10 as view along the 11-11 section lines of FIG. 10, and also illustrating a building wall, adhesive, and wall cladding panel gripped by the gripper plate.
Figure 15:
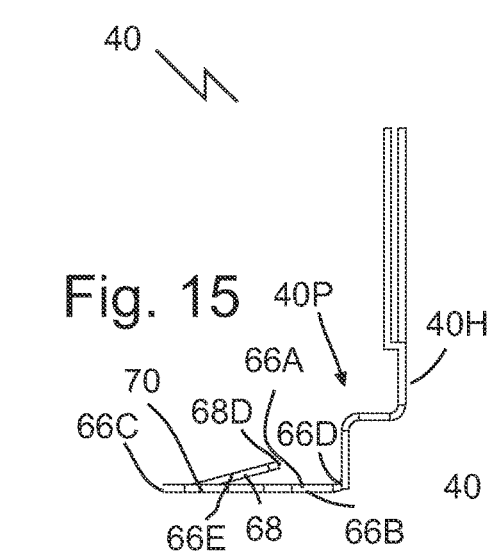
FIGS. 13-16 are perspective, front elevation, side elevation, and top plan views, respectively, of a panel connector part with a one-way insertion tab and a pull-out restricting tab cut out from the insertion tab.
Figure 14:
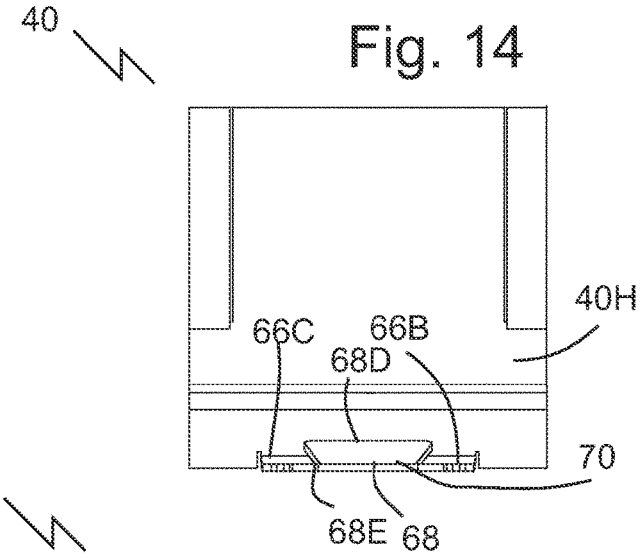
Figure 16:
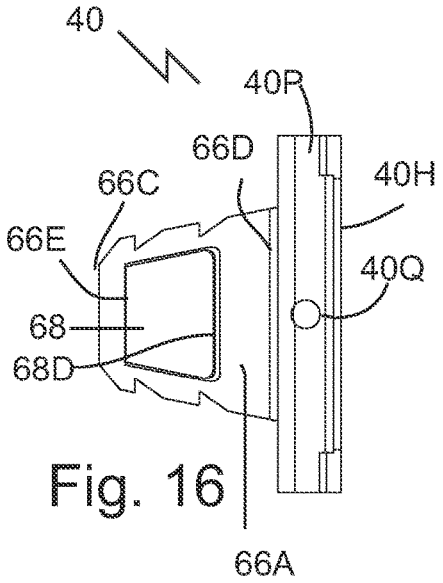

Referring to FIGS. 10-12, an embodiment of a system 10 is shown incorporating panel connector parts 40 mounted as a continuous thermal break layer against the building wall 11. Parts 40 may be are structured to engage the wall cladding panels 12 without extending to the exterior faces 12A of the panels 12, to avoid creating a thermal bridge to the exterior faces 12A. In the example shown the parts 40 engage in use the rear faces 12A of the plurality of wall cladding panels 12 at interior locations, spaced from the side edges, of each of the plurality of wall cladding panels 12, to mount the plurality of wall cladding panels 12 as a continuous thermal break layer against the building wall 11. The parts 40 may form wall cladding panel gripper plates. The panel connector parts 40 may each comprise a base wall mount 40H and a lance part, such as one or more panel fastener parts 56 that extend out of an exterior face 40H-2 of the base wall mount 40H in a lateral direction. The lance parts may extend into the rear face 12A of a respective wall cladding panel 12. The parts 40 may be used to mount a dual insulating layer 60 and 44 to the wall 11.

Referring to FIGS. 10-12 the system may comprise adhesive 64 mounting the plurality of wall cladding panels 12 to the building wall 11. The system 10 illustrated may be provided as a mechanism to support relatively heavy insulation such as mineral wool as the insulation layer 44 or core 14, or in some cases as the panel 12 itself. The system 10 may also permit the mounting of insulating layers or plural insulating layers with a drainage gap therebetween. Relatively lighter forms of insulation, such as expanded polystyrene may not require such support. However, for relatively heavy or dense insulation, fastener parts 56 may provide hangers that support the insulation while the adhesive 64 cures. A suitable adhesive may be used, such as polymer modified cement. The adhesive 64 may sit between the base wall mount 40H and the respective rear faces 12A of the plurality of wall cladding panels 12, for example within an adhesive cavity 40P defined between the mount 40H and the rear face 12A in use. One or more drainage spacer parts 58 such as posts may extend out of the exterior face 40H-2 of the base wall mount 40H in a lateral direction into contact with the rear face 12A of the respective wall cladding panel 12 to define an adhesive cavity 40P and/or a drainage cavity or system 22. The parts 58 may have a suitable insulation contact surface 58A, such as a flat top as shown. The part 58 may have a suitable height 58B to provide the requisite cavity.

Referring to FIGS. 10-12, a suitable number and arrangement of fastener or lance parts 56 may be used. A plurality of panel fastener parts 56 may be arranged at different angular positions about an axis 40M, of the base mount 40H, that is perpendicular to the building wall 11. The base wall mount 40H may have a suitable shape, such as that of a plate. The plate may have a suitable shape, such as a circular or oval cross-sectional shape, as indicated by peripheral edge profile 40N.

Referring to FIGS. 10-12, suitable lance parts 56 may be used, such as one-way fastener parts. A one-way fastener part may be inserted to penetrate but not generally remove from a material without flexing of or damage to the material. A one-way fastener part may have one or more of ridges 56C, barbs, shark teeth, latches, or other features to prevent pull-out upon insertion. The one-way fastener part 56 may comprise a Christmas tree fastener as shown. A Christmas tree fastener may have a suitable height 56A from tip 56B to base mount 40H. The height 56A may be selected to avoid the tip 56B from penetrating to the front face 12A of the panel 12, instead leaving a depth or distance 46G between tip 56B and front face 12A sufficient to provide a thermal break. The distance 46G may be less than or equal to the depth 46H of the exterior layer 46. The fastener part 56 provides resistance to gravitational shear stress, while the provision of one-way features provides resistance to axial stress. In some cases, wall connector parts 42 may be provided to interlock or interact with the parts 40 to improve mounting of the panel 12 to the wall 11.

Referring to FIGS. 10-12, the part 40 may have one or more wall anchor parts 54. One or more wall anchor parts 54 may extend out of a rear face 40H-1 of the base wall mount 40H in a lateral direction into the building wall 11. The one or more wall anchor parts 54 may comprise one or more of a wall lance part (such as a pin shown) and a fastener. A plurality of wall anchor parts 54 may be located in a suitable fashion on mount 40H, such as arranged at different angular positions about an axis 40M, of the base mount 40H, that is perpendicular to the building wall 11. The use of wall anchor parts 54 provides further resistance to shear and axial stress. The one or more wall anchor parts 54 may comprise a fastener 52, such as a bolt passed through an aperture 40K such as a bolt hole through the base mount 40H.

Figures 44, 45, 46, 47, 48:
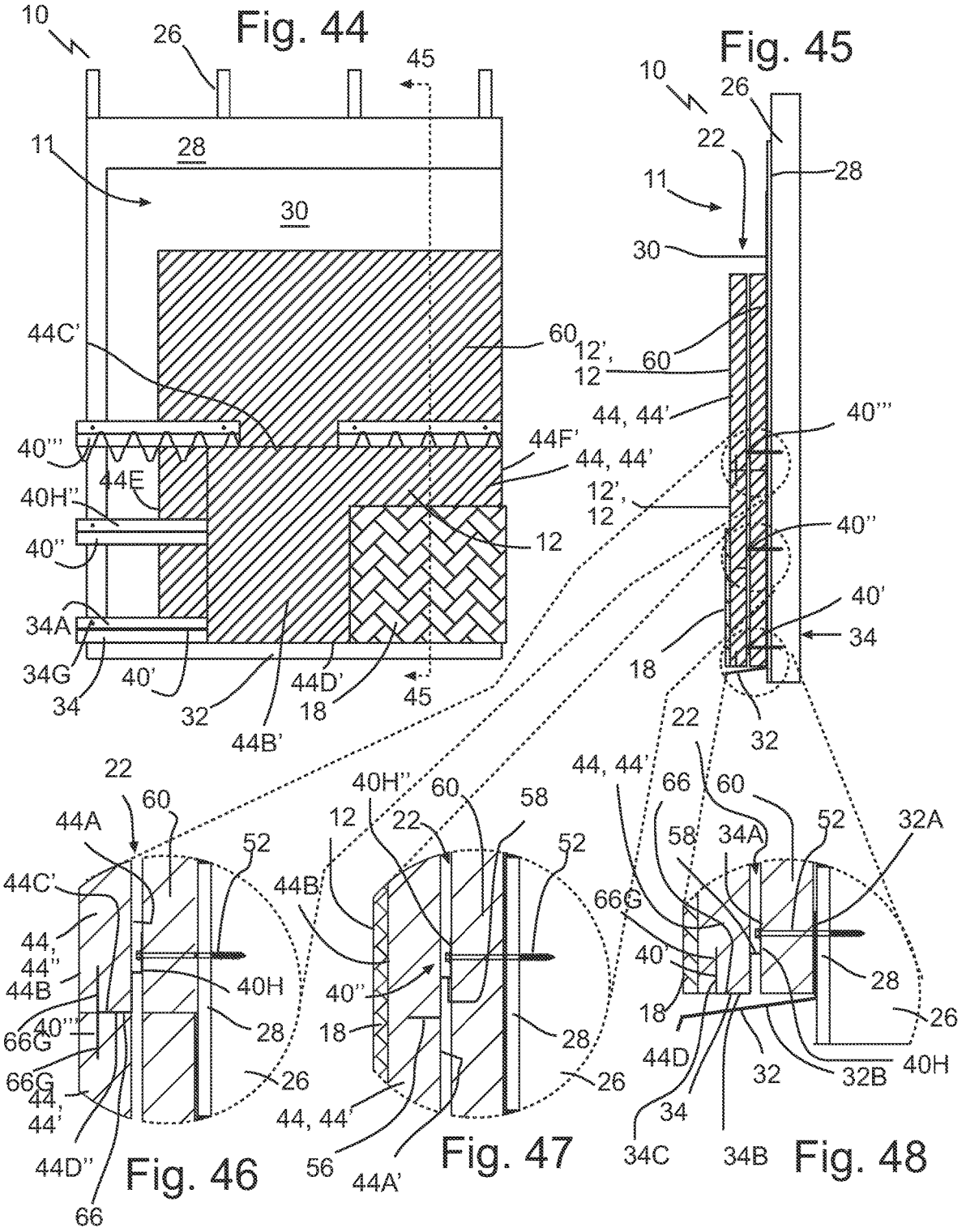
FIG. 44 is a front elevation cutaway view of a wall cladding system on a building wall.
FIG. 45 is a section view taken along the 45-45 section lines of FIG. 44.
FIGS. 46, 47, and 48 are close ups of the views denoted by dashed lines in FIG. 45.
Figure 51:
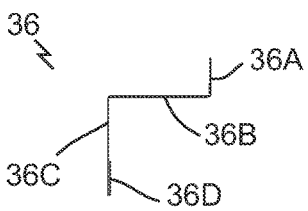
FIG. 51 is a side elevation view of the top strip panel connector part of FIG. 50.
Figure 49:
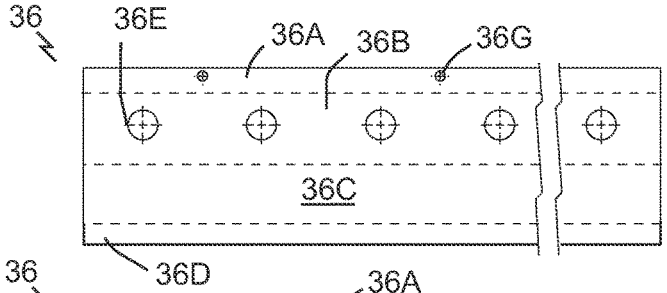
FIG. 49 is a top plan view of a blank sheet used to form a top strip panel connector part.
Figure 50:
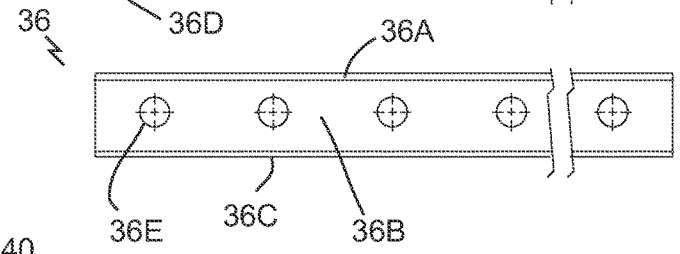
FIG. 50 is a top plan view of the top strip panel connector part of FIG. 49 folded to shape.

Referring to FIGS. 44-45 and 47, another embodiment of a system 10 is shown incorporating panel connector parts 40 mounted on the building wall 11 that are structured to engage the wall cladding panels 12 without extending to the exterior faces 12A of the panels 12, to avoid creating a thermal bridge to the exterior faces 12A. The parts 40" may be mounted as elongate strips that run at least partially between side edges 46E, 46F of each layer 46 (panel 12). The system 10 illustrated permits the construction of a dual insulation layer (layers 60 and 44) with an integral drainage cavity or system 22. The parts 40 may operate to achieve several functions, such as a) mounting a first or internal layer 60 against wall 11, for example to act as a fastener and washer that supports the layer 60 against the wall 11, b) securing and mounting the external or second layer 44 against the layer 60, c) defining and retaining a drainage system 22, such as a planar gap as shown, therebetween the layers 60 and 44, and d) avoid penetrating or extending to the external face 44B of the layer 44, to permit the layer 44 to act as a true thermal break. The parts 40" engage rear faces 44A at interior locations, spaced from the side edges 44E, 44F, of each of the plurality of wall cladding panels 12.

Referring to FIGS. 13-16, an example of panel connector parts 40 that would be suitable for use as parts 40" (mid clips) with the system 10 of FIG. 44 are illustrated. The panel connector parts 40 may be formed out of a sheet of material, which may be bent and/or cut to form the panel connector part 40, such as bent to define the respective parts such as parts 58, 58C, tab 68, and part 66. The lance or one-way fastener part 66 has barbed side edges 66E and points in a lateral direction to lance and insert into the insulation layer 44 in use (see FIG. 45). The fastener part 66 may have suitable components, such as side edges, a leading end or tip 66C opposed an anchor end 66D, a top face 66A and a base face 66B. The connector part 40 may have a pull-out restricting part, such as a tab 68 to restrict or prevent the fastener part 66 from being removed from the insulation layer 44 upon insertion. Tab 68 may have suitable components, such as side edges 68E, a leading end 68C, a cantilevered trailing end 68D, a top face 68B and a base face 68A. The pull-out restricting tab 68 may form part of the fastener part 66. The tab 68 may be mounted to pivot relative, for example by a hinge 70, to the one-way fastener part 66. The hinge 70, which may be a suitable hinge such as a resilient or living hinge as shown, may define a leading end 68C of the pull-out restricting tab 68, which forms a cantilever that is directed one or more of upward, downward, or toward the base wall mount 40H. In the example shown, the tab 68 is biased upward relative to a plane defined by the top face 66A of the fastener part 66, for example at a suitable insertion angle such as fifteen degrees (although other angles more or less may be used). Thus, upon insertion of fastener part 66 into insulation layer 44, the insulation layer 44 contacts top face 68B and pushes the tab 68 downward. After insertion, if a user pulled back on the clip or panel connector part 40, the cantilever end 68D would engage the insulation layer 44, causing the tab 68 to rotate upward and bit into the insulation layer 44, restricting or preventing removal. Similar to the connector part 40 shown in FIG. 11, the connector part 40 may have spacer parts 58, such as shoulders 58C, that define an adhesive cavity 40P to receive adhesive (not shown) to adhere the insulation layer 44 to the wall and part 40. The mount 40H may have suitable apertures 40K and/or 40Q to secure to the wall via fasteners (not shown). The parts 40 may be mounted by a suitable fastener 52, which may have adhesive applied to it prior to or during insertion for increased securing strength and reduced heat transfer. In some cases, suitable adhesive may be applied to fasteners 52 prior to engaging wall 11, for example, double-sided tape, caulking, polymeric glue, or others may be used. In some cases, the fasteners 52 may be pre-applied with adhesive prior to use, for example fasteners 52 may be supplied in kit form or otherwise to the consumer with pre-application of adhesive, for example, using a peel-and-stick adhesive tape. In some cases, resilient material may be pre-coated or pre-applied to fasteners 52, for example the fasteners 52 may be dipped in silicone caulking and dried, with the application of the fasteners 52 thereafter compressing the resilient material against the apertures 40*k* to provide a better seal with base mounts 40H than if standard fasteners with or without washers were used.

Figure 13:
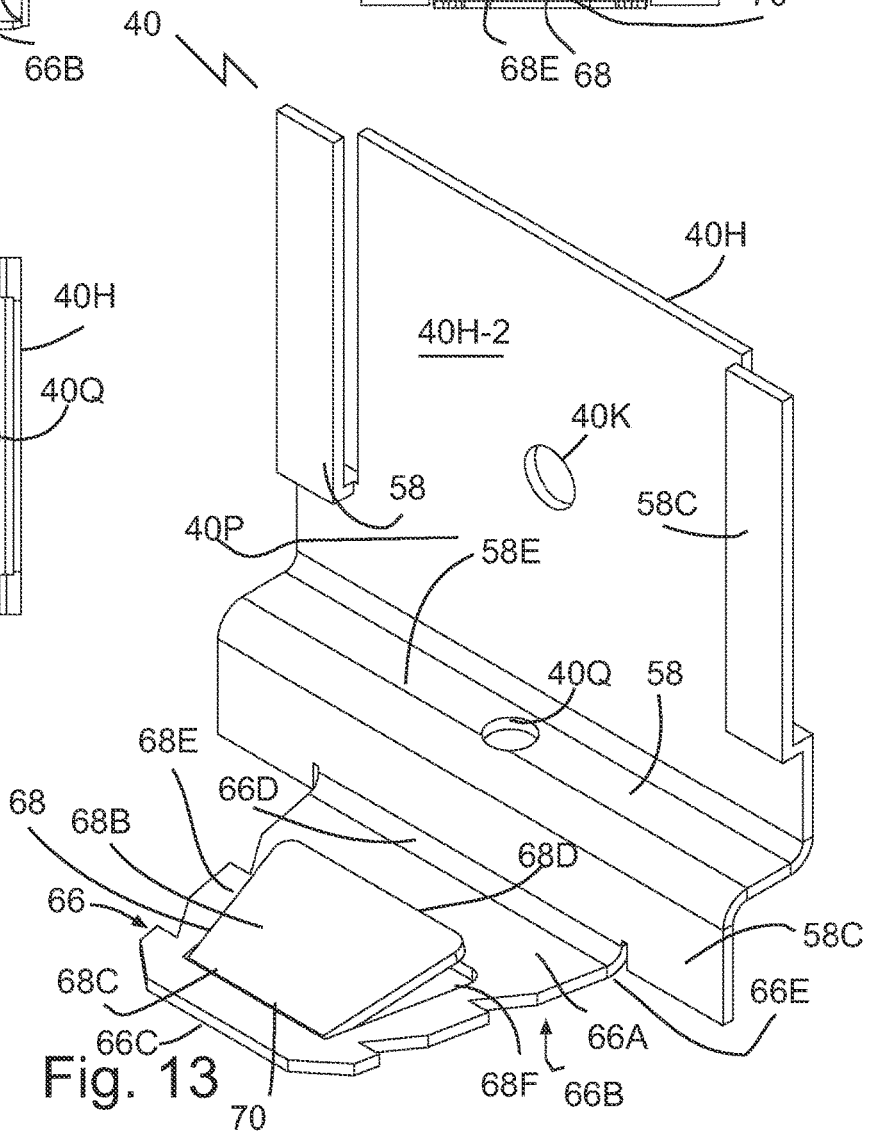
Figures 17, 18, 19, 20:
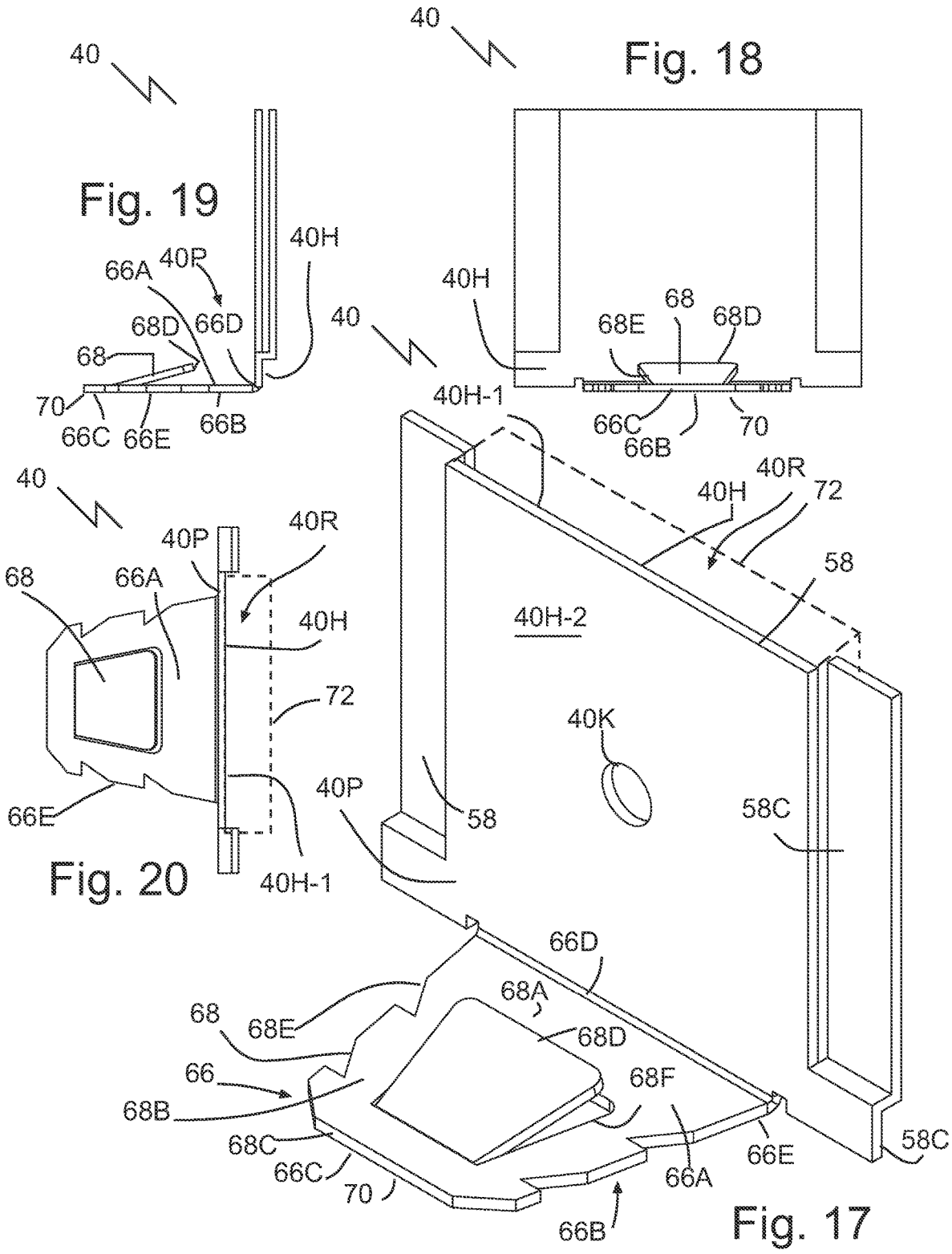
FIGS. 17-20 are perspective, front elevation, side elevation, and top plan views, respectively, of another embodiment of a panel connector part with a one-way insertion tab and a pull-out restricting tab cut out from the insertion tab.
Figure 21:
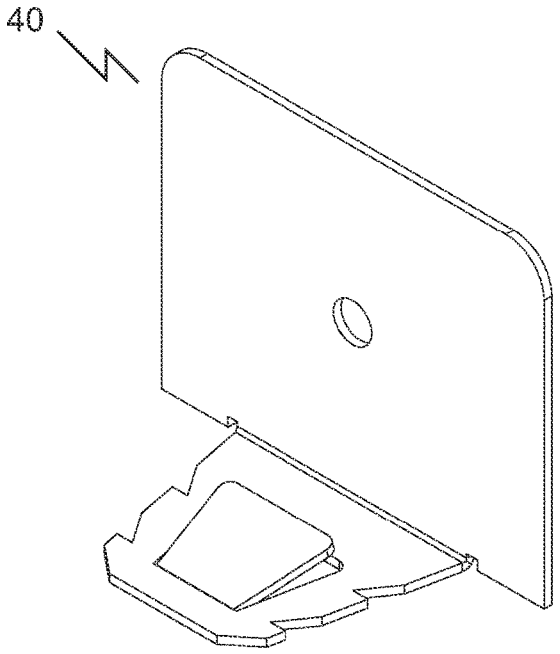
FIGS. 21-26 are perspective views of various embodiments of panel connector parts with a one-way insertion tab and pull-out restricting tab.
Figure 22:
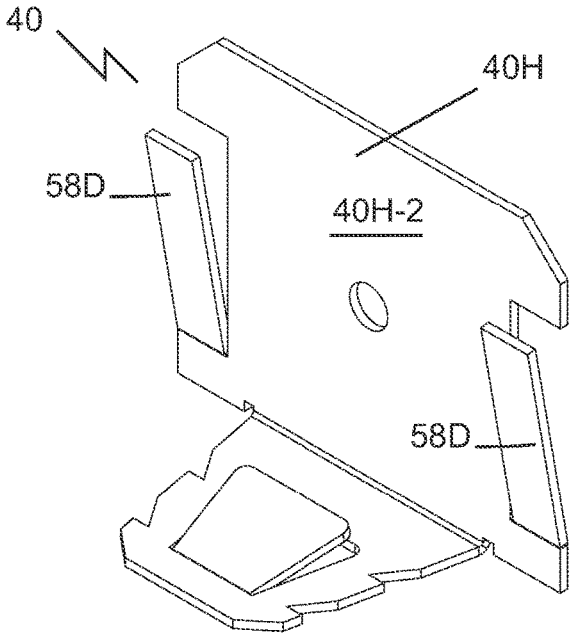
Figure 23:
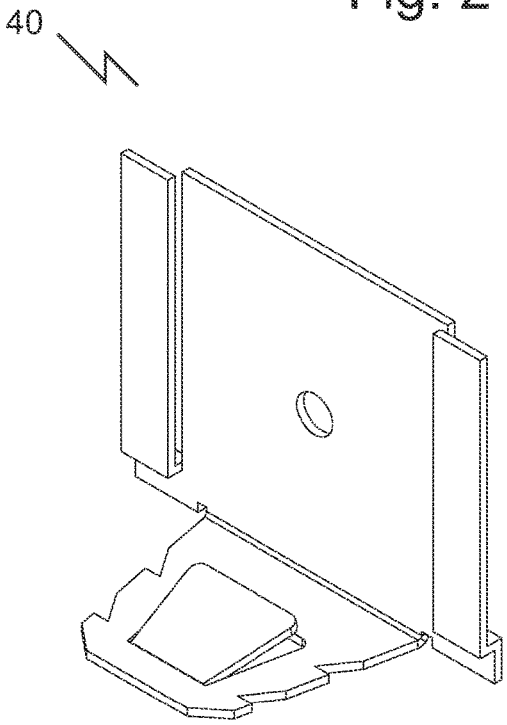
Figure 24:
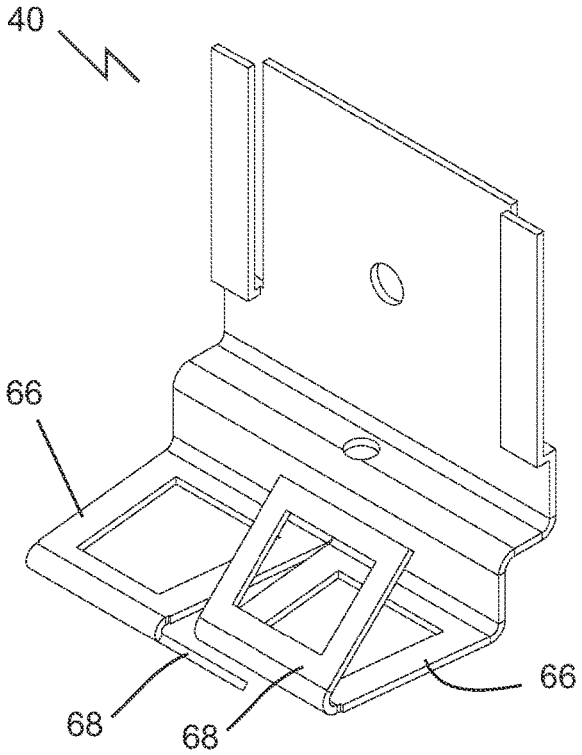
Figure 25:
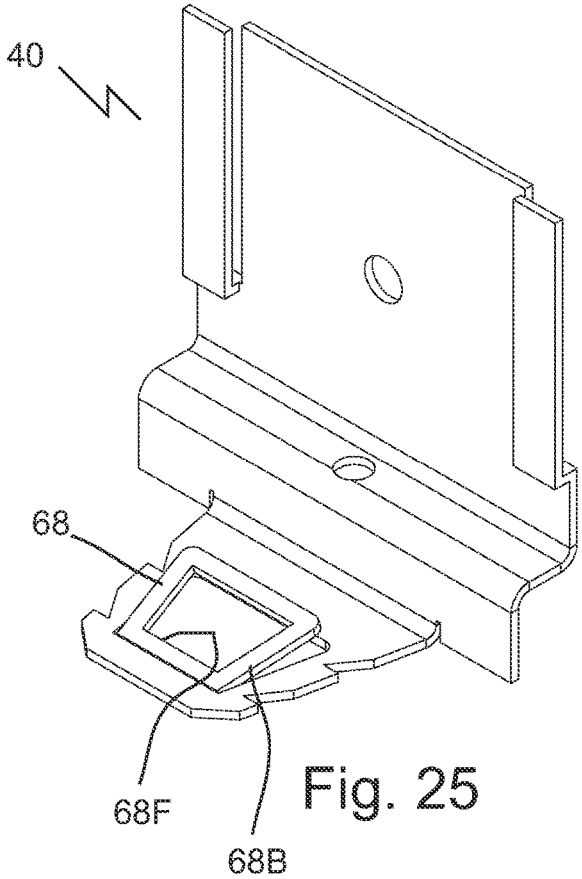
Figure 26:
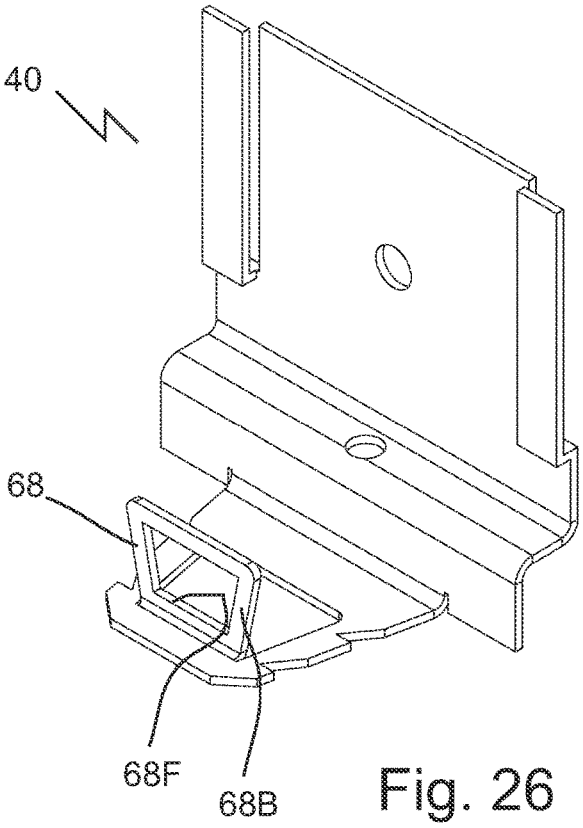
Figure 29:
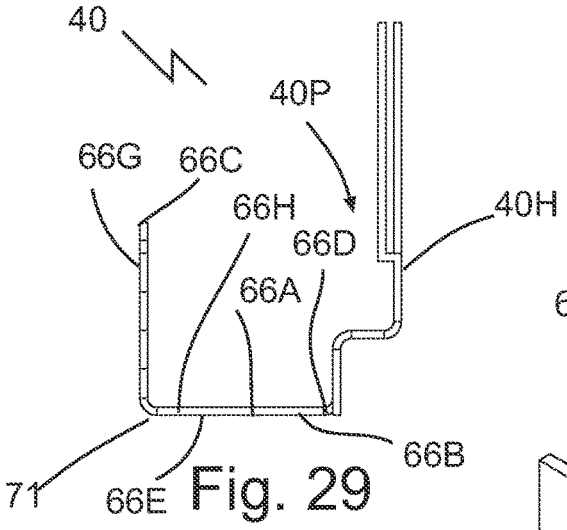
FIGS. 27-30 are perspective, front elevation, side elevation, and top plan views, respectively, of another embodiment of a panel connector part with a one-way insertion tab structured to engage an edge of a wall cladding panel.
Figure 28:
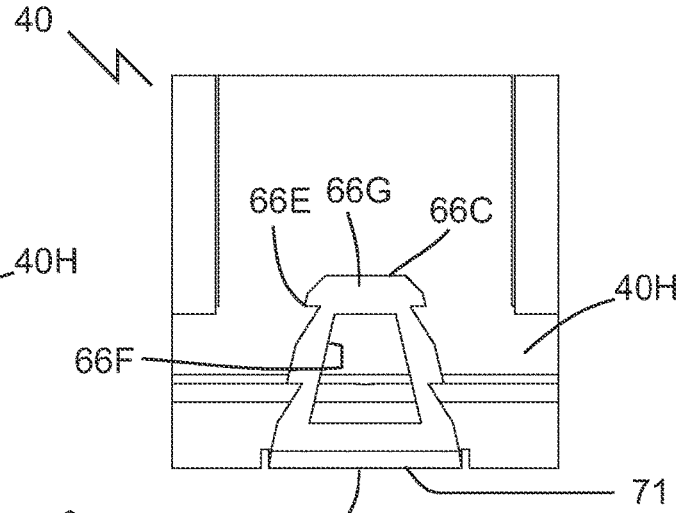
Figure 30:
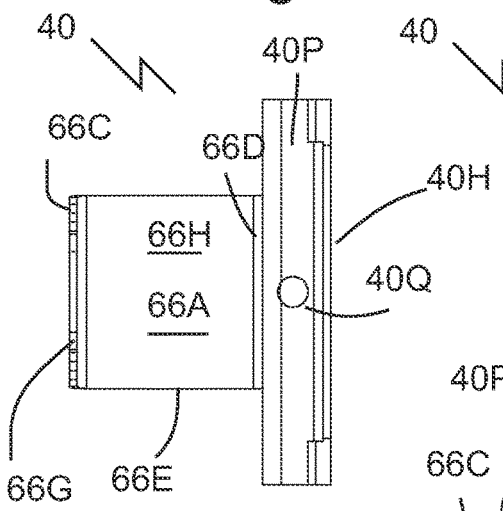

Referring to FIGS. 17-26, various embodiments of other panel connector parts 40 suitable for use as parts 40" in FIG. 44 are shown. Referring to FIGS. 17-20, the parts 40 are similar to the parts 40 from FIGS. 13-16 with some differences. With parts 40 of FIGS. 17-20, the base mount 40H is structured to rise away from the insulating layer 60 and/or wall using shoulders 58, to define a rear cavity 40R between rear face 40H-1 and insulating layer 60 and/or wall to receive insulation, such as an insulating pad 72. The pad 72 may be a relatively thin strip of aerogel in some cases, to minimize heat transfer between base 40H and the insulating layer 60 and/or wall. Referring to FIG. 21, a part 40 is shown lacking shoulders 58C or spacer parts 58. Referring to FIG. 22, a variation of the part 40 of FIG. 21 is shown, with arms 58D anchored to cantilever from base mount 40H, away from front face 40H-2 to contact the rear face of the insulating layer 44 to define a drainage gap. Referring to FIG. 23, a variation of the part 40 from FIG. 13 is illustrated, lacking a base shoulder or ledge 58E that anchors the part 66 in FIG. 13. Referring to FIG. 24, the part 40 may have plural pull-out restricting tabs 68, such as a pair of tabs 68, with one or both pointing down, and one or both pointing up. Referring to FIGS. 25-26, a series of figures are shown for a variation of the part 40 of FIG. 13, with a window 68F defined in the leading face 68B of the tab 68, Referring to FIGS. 44-46 and 48, in the example shown the parts 40' and 40" engage the edges 44C, 44D of the plurality of wall cladding panels 12 (in this case, more precisely, panels of exterior insulating layer 44) to mount the plurality of wall cladding panels as a continuous thermal break layer against the building wall. The parts 40" may engage the panels 12 at intermediate locations, spaced from front faces 44B, for example partway between faces 44A and 44B of layer 44. Two types of parts 40 are illustrated. Referring to FIG. 48, a starter row of panels (layer 44) is shown, with a base flashing or hanger 34, and a base hanger or connector part 40 mounted to the insulating layer 60 and/or wall. The part 40' forms a starter hanger 34, with a mounting strip 34A, a panel support flange 34B, and a panel base receiver 34C. The receiver 34C defines the one-way fastener part (for example upright fastener part 66G), that engages base edge 44D in layer 44. Referring to FIG. 44, a part 40'" is shown that engages both the abutting edges (in this case top edge 44C' and base edge 44D" of layers 44' and 44", respectively) of adjacent panels. The part 66 may have a base mount 40H, with a shoulder 58 that defines a drainage gap between layers 60 and 44, and that mounts fastener part 66. The part 66 may connect to upright and down oriented fastener parts 66G that pierce or penetrate the base edge 44D" and top edge 44C'. Referring to FIGS. 44, the parts 40' and 40'" may form elongate strips as shown. In a method of installation, a user may install the starter hanger 34 (part 40') and mid clip or part 40", then slide the layer 44 downward to pierce the part 40' and 40", then install the top clip or part 40'" to secure the panel or layer 44 in place to provide a thermal break. A decorative finishing layer 18 may be provided over layer 44, or as part of layer 44 in the case of panels 12. The layer 18 may be provided on layer 44 in a prefabricated manner or may be applied after installation of layer 44. Layer 18 may include a suitable finish, such as a metal finish, stucco, plaster, or others.

Figure 27:
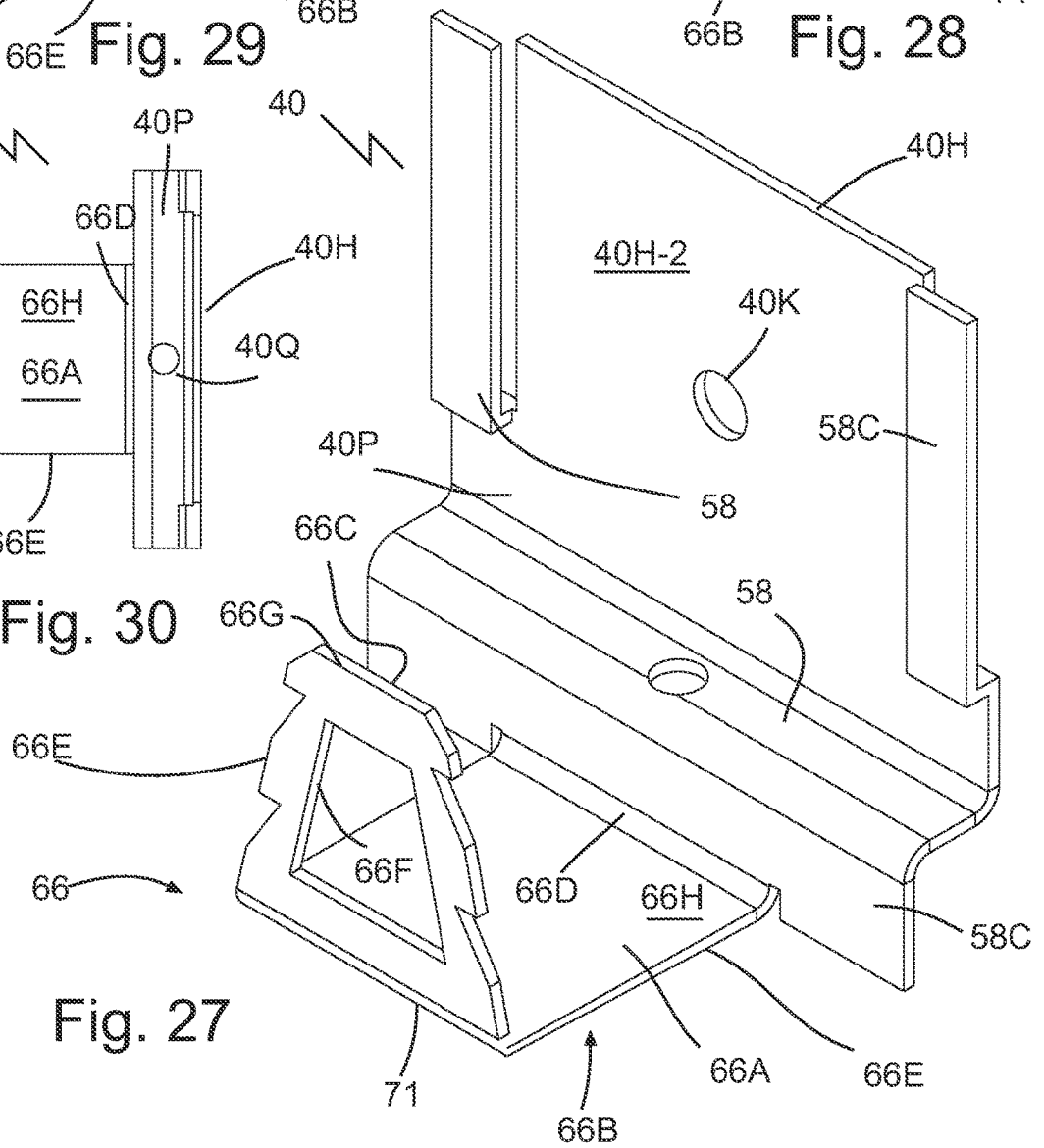
Figure 33:
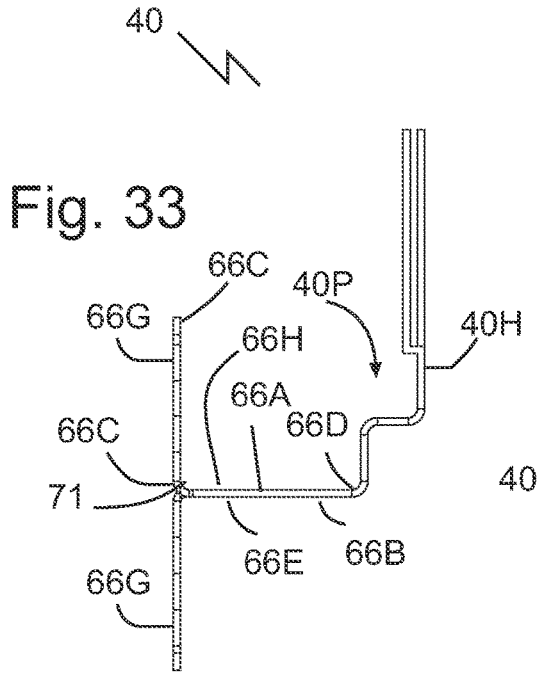
FIGS. 31-34 are perspective, front elevation, side elevation, and top plan views, respectively, of another embodiment of a panel connector part with a one-way insertion tab structured to engage a base edge and top edge of adjacent abutting wall cladding panels.
Figure 32:
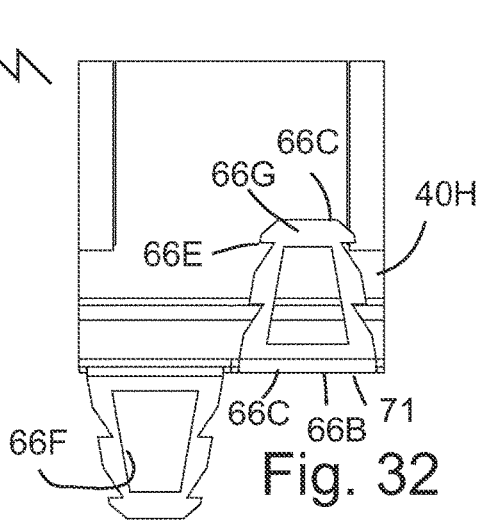
Figure 34:
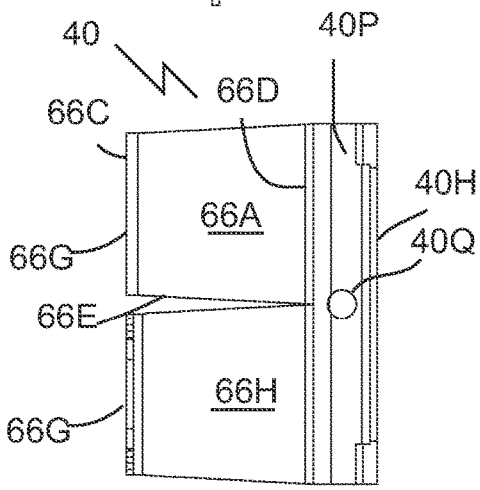
Figure 31:
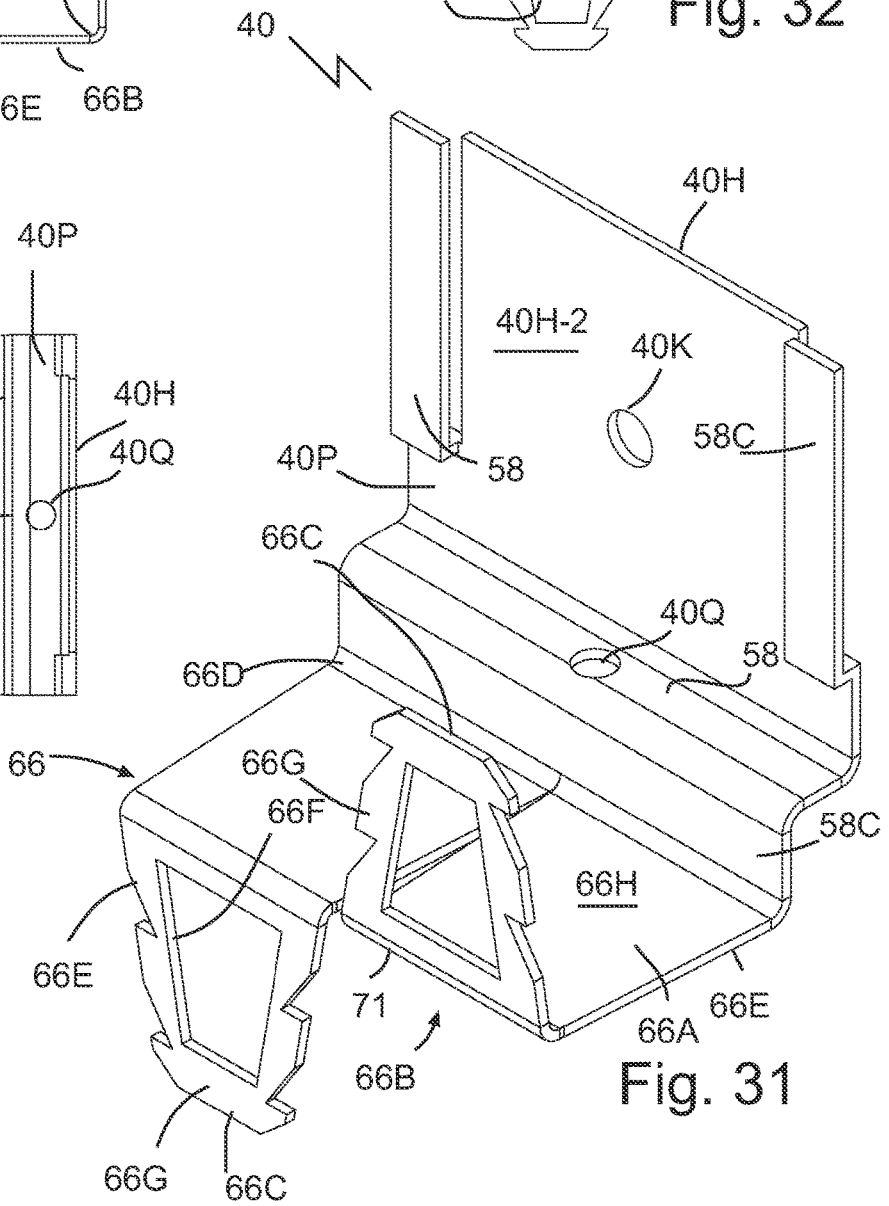
Figure 37:
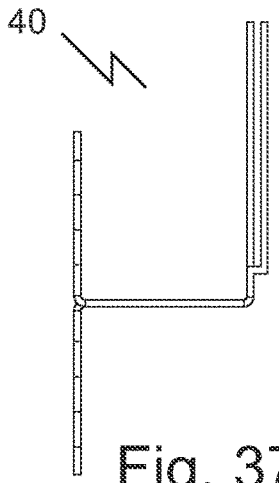
FIGS. 35-38 are perspective, front elevation, side elevation, and top plan views, respectively, of another embodiment of a panel connector part with a one-way insertion tab structured to engage a base edge and top edge of adjacent abutting wall cladding panels.
Figure 36:
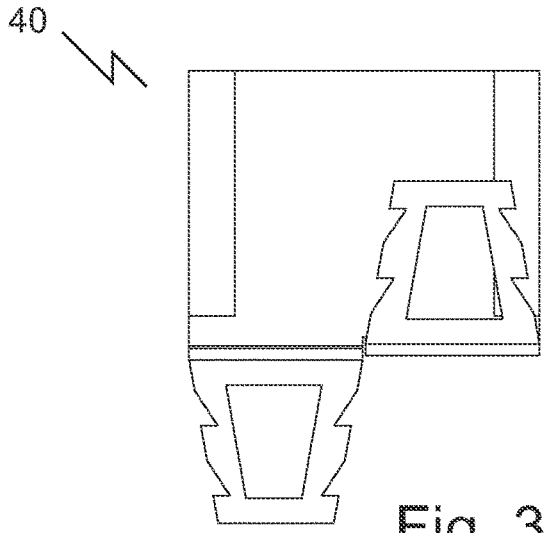
Figure 38:
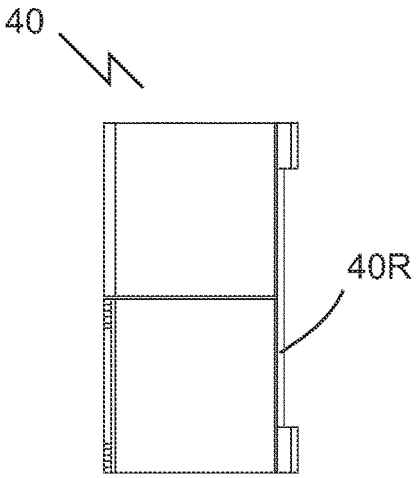
Figure 35:
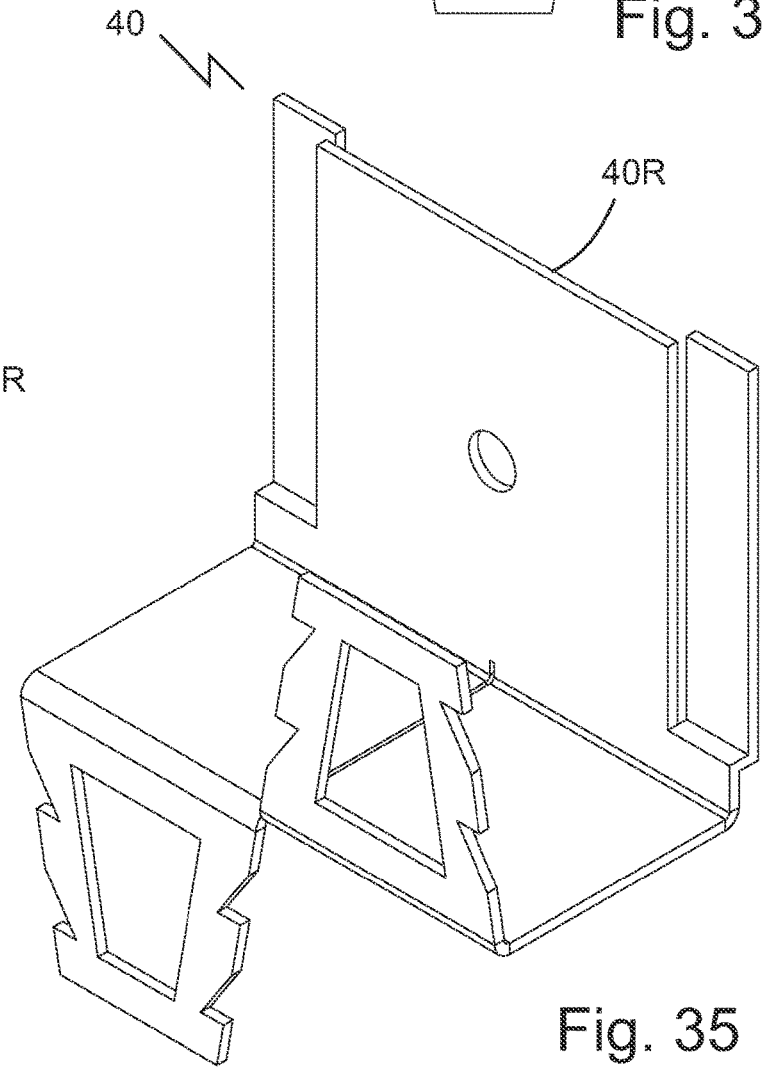
Figure 39:
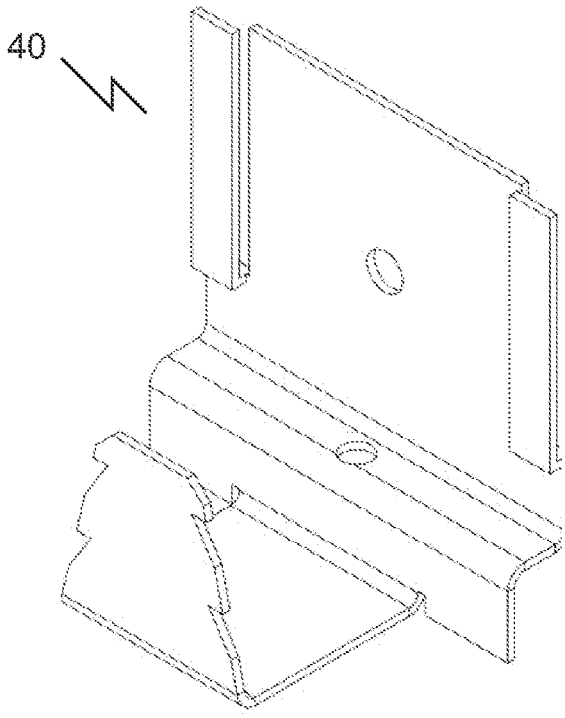
FIGS. 39-43 are perspective views of various embodiments of panel connector parts for engaging the edges of wall cladding panels.
Figure 40:
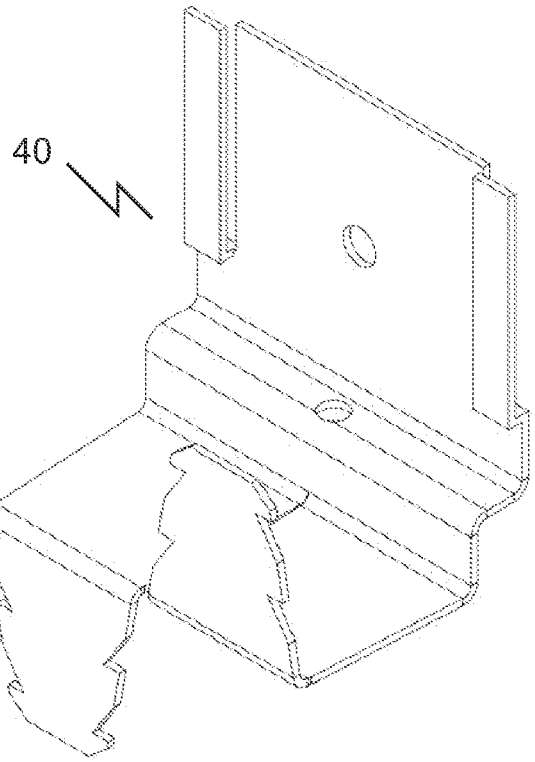
Figure 41:
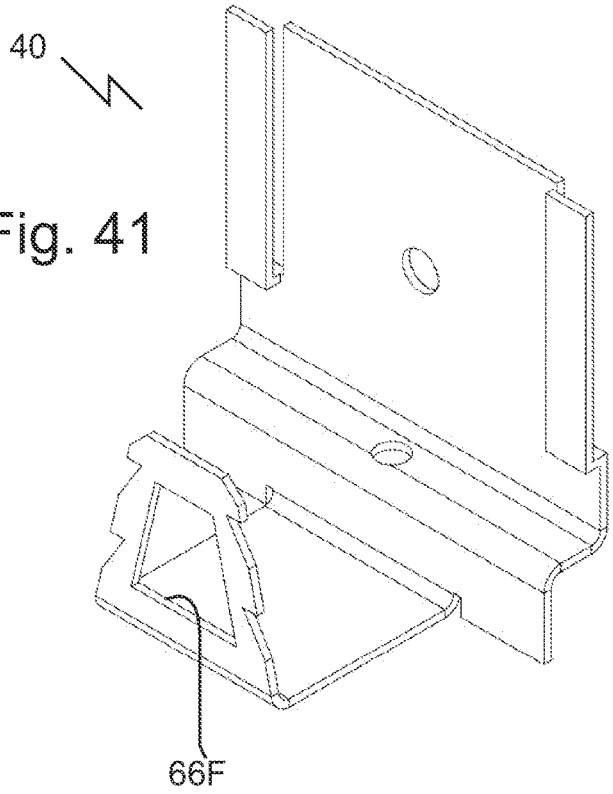
Figure 42:
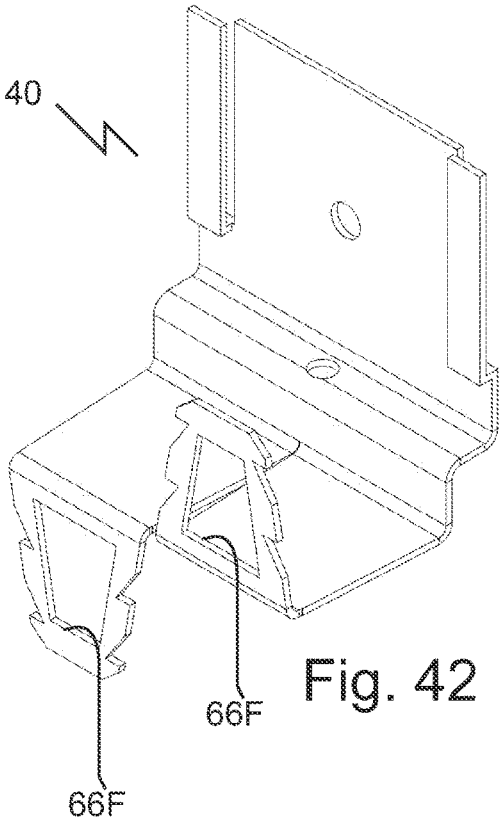
Figure 43:
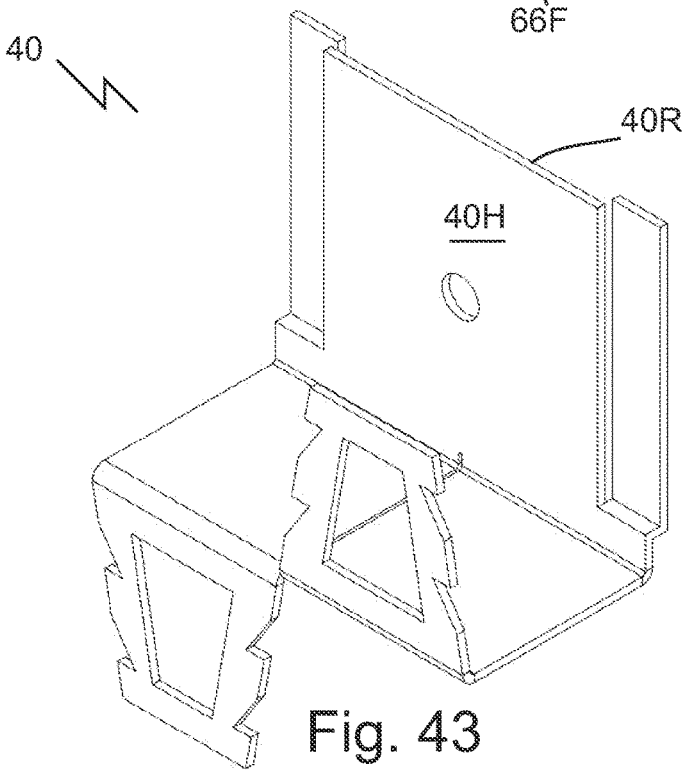

Referring to FIGS. 27-43, various embodiments of other panel connector parts 40 suitable for use as parts 40' (bottom or starter clips) or 40'" (top clips) in FIG. 44 are shown. Referring to FIGS. 27-30, the part 40 has the structure of the part 40 from FIG. 13, except that the pull-out tab 68 is omitted and replaced with an upright fastener part 66G, which defines the tip 66C. The part 66G may define a window 66F, and barbed side edges 66E. The part 66G may be directed upward in cantilever fashion from a rigid bend or junction 71, from which the part 66G is anchored to a shelf part 66H. The part 66G may be structured to pierce layer 44 in an upward direction, to pierce a base edge 44D of layer 44. The part 40 shown in FIGS. 27-30 may be suitable for use in a starter hanger 34, as part 40' in FIG. 44. Referring to FIGS. 31-34, another variant of the part 40 is shown, with similar structure to the part 40 in FIG. 27 except that a plurality of upright fastener parts 66G are provided, for example a pair, with one-part 66G directed upward and one-part 66G directed downward, for piercing in use the base edge 44D of a layer 44, and the top edge 44C of an abutting adjacent layer 44, respectively. Referring to FIGS. 35-38, a variant of the part 40 from FIG. 31 is shown, with the differences that the base shelf or shoulder 58 is omitted and the rear cavity 40R is defined between rear face 40H-1 and insulating layer 60 and/or wall to receive insulation. Referring to FIG. 39, a variant of the part 40 of FIG. 27 is shown, with the window 66F omitted. Referring to FIG. 40, a variant of the part 40 of FIG. 31 is shown, with the windows 66F omitted. Referring to FIGS. 41-42, variants of the parts 40 from FIGS. 39-40, respectively, are shown, with windows 66F added. Referring to FIG. 43, a variant of the part 40 of FIG. 42 is shown with an insulating receiving cavity 40R defined by the base mount 40H.

Figure 61:
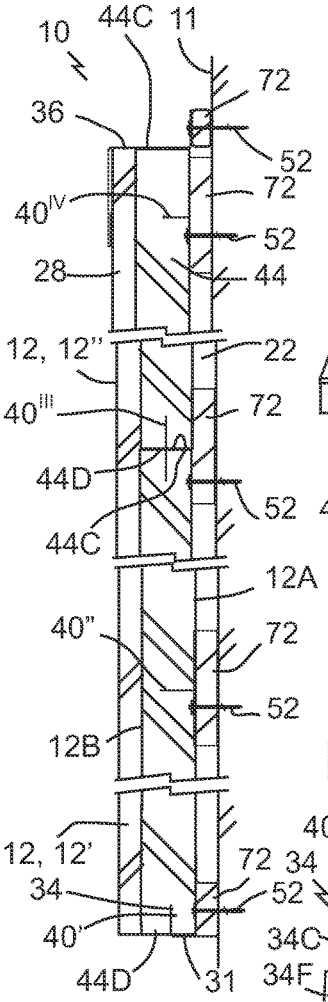
FIG. 61 is a vertical cross-sectional view of a part of a wall cladding system on a building wall, incorporating the panel connector parts of FIGS. 52, 55, and 58.
Figure 52:
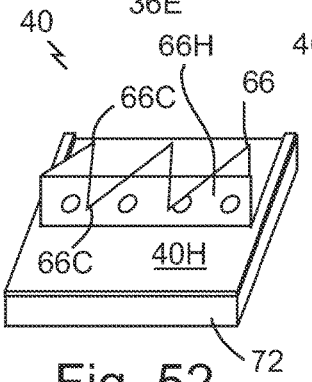
FIGS. 52-53 are perspective and side elevation views, respectively, of an-end clip panel connector part.
Figure 53:
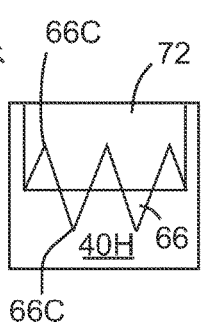
Figure 54:
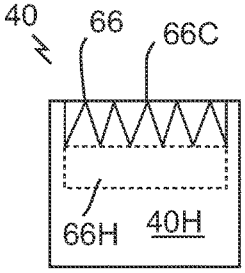
FIG. 54 is a side elevation view of a blank sheet used to form the end-clip panel connector part of FIG. 52.
Figure 55:
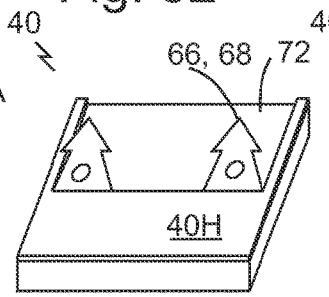
FIGS. 55-56 are perspective and side elevation views, respectively, of a mid-clip panel connector part.
Figure 56:
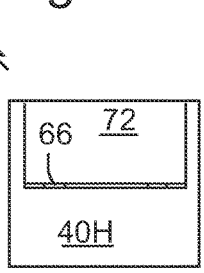
Figure 57:
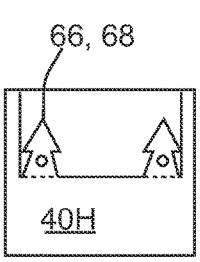
FIG. 57 is a side elevation view of a blank sheet used to form the mid-clip panel connector part of FIG. 55.
Figure 58:
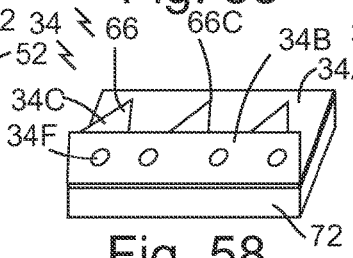
FIGS. 58-59 are perspective and side elevation views, respectively, of starter strip panel connector part.
Figure 59:
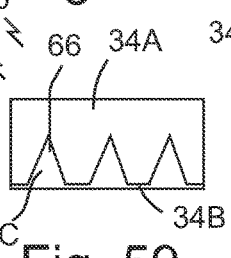
Figure 60:
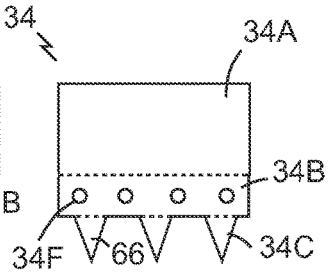
FIG. 60 is a side elevation view of a blank sheet used to form the starter strip panel connector part of FIG. 58.
Figure 74:
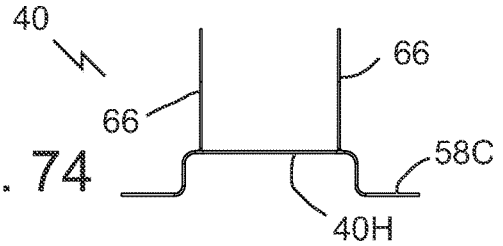
FIGS. 74-77 are end elevation, side elevation, top plan, and perspective views, respectively, of another dual lance mid-clip panel connector part.

Referring to FIG. 61 a further embodiment of a wall cladding system 10 is illustrated incorporating panel connector parts 40 mounted on a building wall 11. As above, parts 40 may be structured to engage the wall cladding panels 12 without extending to the exterior faces 12A of the panels 12, to avoid creating a thermal bridge to the exterior faces 12A. Referring to FIGS. 52-60, a variety panel connector parts 40 suitable for use with system 10 are illustrated. The parts 40 may each comprise a base wall mount 40H, and an insulative backing layer or pad 72. The pads 72 may act as a drainage spacer part that extends out of the base wall mount 40H, for example in a direction toward the wall 11 in use, to space the rear faces of the 12B of the panels 12 to define the drainage cavity or system 22 along the wall 11. As above, the panel connector parts 40 may comprise one or more lance parts, such as fastener parts 66 (which may or may not be one-way fasteners), that define a leading tip 66C and extend out of an exterior face of the base wall mount 40H toward the cladding panels 12. In the example shown, the parts 40 may be formed out of a sheet of material, such as sheet metal, which may be formed into a blank (FIGS. 54, 57, and 60), which may be cut and bent into the desired shapes shown. Dashed lines are shown in FIGS. 54, 57, and 60 to indicate bend lines. Various suitable machining techniques may be used for such modifications of a starter sheet of material to form the respective blanks shown. The base wall mounts 40H may then be secured to a suitable insulative pad 72, for example using adhesive, heat welding, fasteners, or other techniques.

Referring to FIGS. 58-61, a starter hanger 34 is illustrated for use as a panel connector part 40' for a starter row of panels 12'. The base wall mount 40H may form a mounting strip 34A (starter hanger). The fastener part 66 may be structured to extend into the edges, for example the bottom edges 44D, of the panels 12', for example via a leading tip 66C that extends upward from a flange 34B (for example perpendicular to flange 34B) that extends out of the exterior face of the base wall mount 40H in a lateral direction (for example perpendicular to mount 40H) into the edges of the plurality of wall cladding panels. The leading tips 66C may have a triangular shape as shown, or another suitable shape. The flanges 34B may have weeping holes 34F for drainage. A fastener 52 may extend in use through the mount 40H to secure the part 40' on the wall 11. In order to install the starter row, a user may position panels 12' atop the leading tips 66C, with rear faces of the panels 12 abutting the base wall mount 40H, and thereafter apply downward pressure on the panel 12 to allow the fastener parts 66 to penetrate the bottom edges 44D to securely mount the panels 12', while defining drainage system 22 at the same time.

Figure 90:
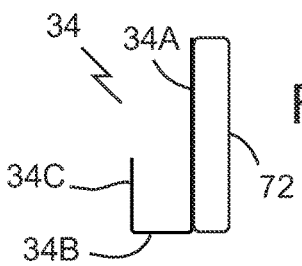
FIG. 90 is a top plan view of another embodiment of a starter strip panel protector part, which is similar to the embodiment of FIG. 85 but with an insulative backing.
Figure 89:
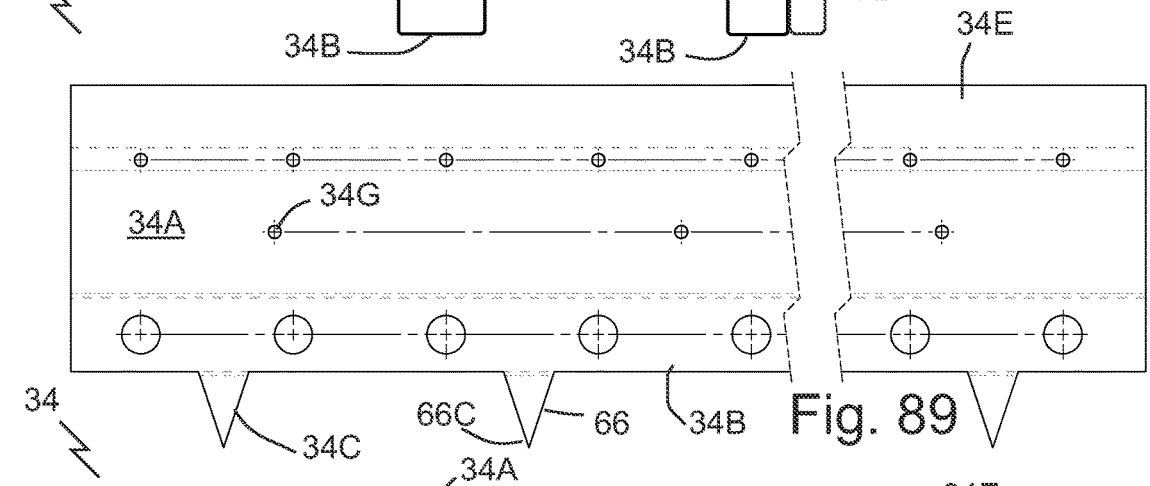
FIG. 89 is a blank sheet used to form the starter strip panel protector part.
Figure 86:
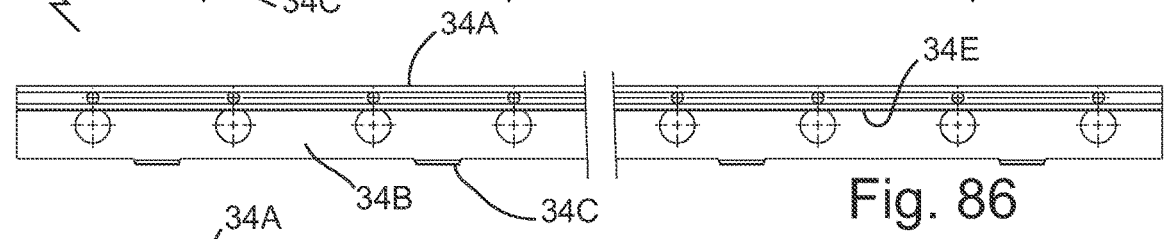
Figure 87:
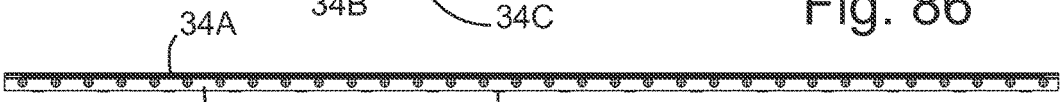
Figure 88:
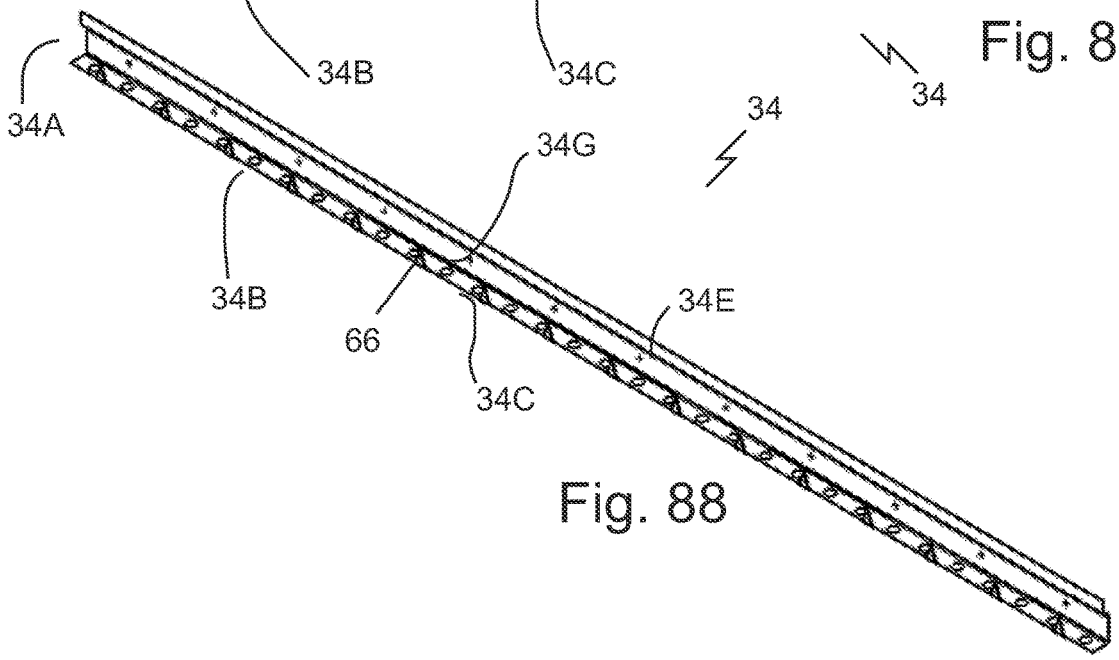

Referring to FIGS. 85-89, a different embodiment of a panel connector part (starter hanger 34) is illustrated suitable for use with the system of FIG. 61. Each hanger 34 may have a mounting strip 34A, a flange 34B, and panel base receiver 34C. Receiver 34C may be defined by one or more fastener parts 66 that run along a longitudinal length of the hanger 34. In general, in this document, where a strip is used in this document, a series of discrete and shorter segments may be used, for example a plurality of parts 40 with one or more lance parts may be used instead of a multi-lance hanger 34 as shown. The embodiment of FIG. 90 differs from that of FIG. 85 only in that drainage spacing is performed by an insulative pad 72.

Referring to FIGS. 55-57 and 61, a panel connector part 40" may be provided to function as a mid-clip for a panel 12 or row of panels 12. Each part 40" may have a base wall mount 40H, and one or more lance parts that define a fastener part 66 that defines a leading tip 66C that extends in a lateral direction into the rear face 12A of a respective wall cladding panel 12, at an interior location, spaced from the edges, of the respective wall cladding panel 12. The mid-clips may be structured to engage and secure the panel 12 between the edges of the panel 12. A suitable number of such parts 40" may be used as needed, for example a plurality of parts 40" may be spaced along the rear face 12A of a panel 12. In the example shown, the leading tips 66C may be formed of one-way fastener parts 66, which may be barbed as shown to prevent unintentional pullout. A fastener 52 may secure the mount 40H to the wall 11. In the example shown, a second mid-clip is shown as part 40' securing the top row of panels 12".

Figure 79:
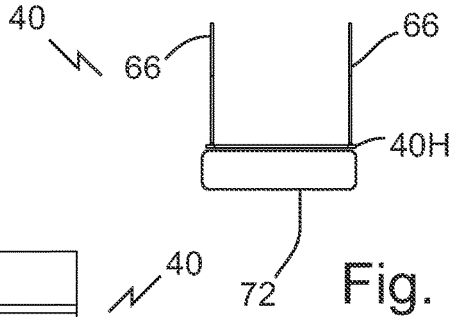
FIG. 79 is a top plan view of another embodiment of a dual lance mid-clip panel protector part, which is similar to the embodiment of FIG. 74 but with an insulative backing.
Figure 75:
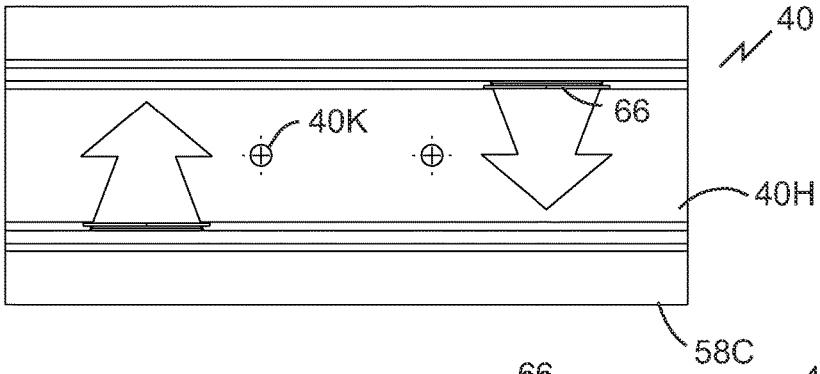
Figure 76:
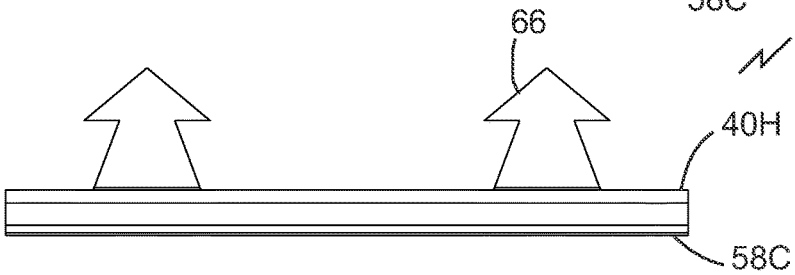
Figure 78:
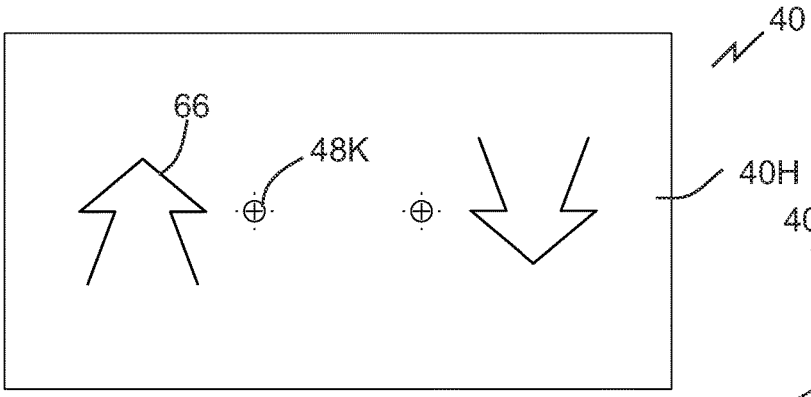
FIG. 78 is a blank sheet used to form the dual lance mid-clip panel protector part.
Figure 77:
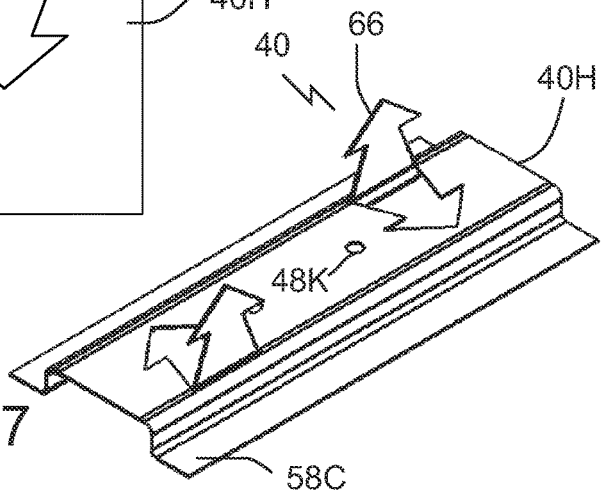

Referring to FIGS. 62-77, different embodiments of panel connector parts 40 are shown that might function as a suitable mid-clip in the system 10 of FIG. 61. Referring to FIGS. 61-66, an embodiment is illustrated with drainage spacer parts 58 defined by shoulders 58C that extend out of wall mount 40H. Fastener parts form one-way fastener parts 66, which may have various apertures 40Q and a common shelf part 66H connecting fastener parts 66. FIGS. 68-72 illustrate a mid-clip embodiment similar to FIG. 62 but with fastener parts 66 staggered between top and bottom edges of the base wall mount 40H. FIGS. 67 and 73 illustrates a variation of the embodiments of FIGS. 62 and 68, respectively, but with drainage spacing provided by an insulative pad 72. Referring to FIGS. 74-78, a variation of mid-clip is illustrated with a base wall mount 40H structured to be raised off of the wall 11 by drainage spacer parts 58 with shoulders 58C that contact wall 11 in use. Similar to FIG. 68 the fastener parts 66 may be staggered laterally and/or vertically from one another. FIG. 79 illustrates a variation of the mid-clip of FIG. 74 with drainage spacing provided by insulative pad 72.

Referring to FIGS. 52-54 and 61, a panel connector part 40'" may be provided to function as an end-clip for vertically abutting panels 12' and 12". The one or more lance parts may define a fastener part 66 that each define a leading tip 66C that extends into the edges 12C, 12D of the plurality of wall cladding panels 12 at intermediate locations, spaced from front faces 12B, of each of the plurality of wall cladding panels 12. Similar to the starter strip embodiment, the fastener parts 66 may define leading tips 66C that extends upward and downward from a flange (shelf part 66H) into the edges 12C, 12D of the plurality of wall cladding panels 12. In the example shown the tips 66C alternate up and down to engage edges 44D and 44C of layer 44 of panel 12, respectively, although other arrangements may be used of tips 66C. The references figures provide an example where at least some of the panel connector parts, i.e., parts 40'", engage abutting edges of adjacent of the plurality of wall cladding panels 12.

Figure 84:
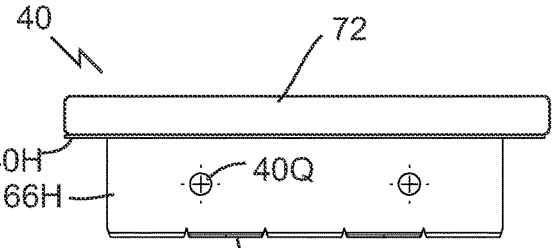
FIG. 84 is a top plan view of another embodiment of a dual lance end-clip panel protector part, which is similar to the embodiment of FIG. 80 but with an insulative backing.
Figure 81:
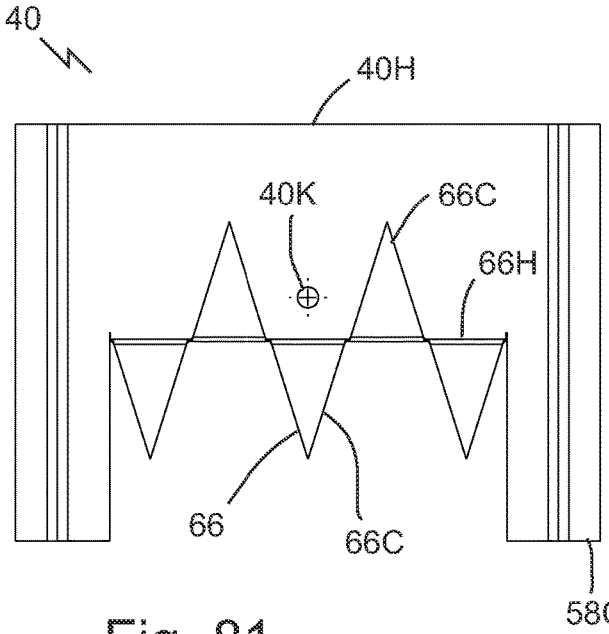
Figure 82:
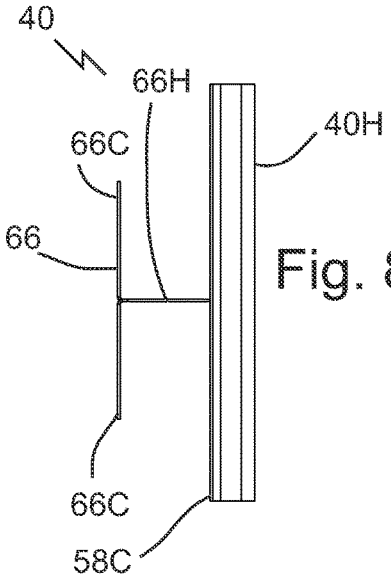
Figure 83:
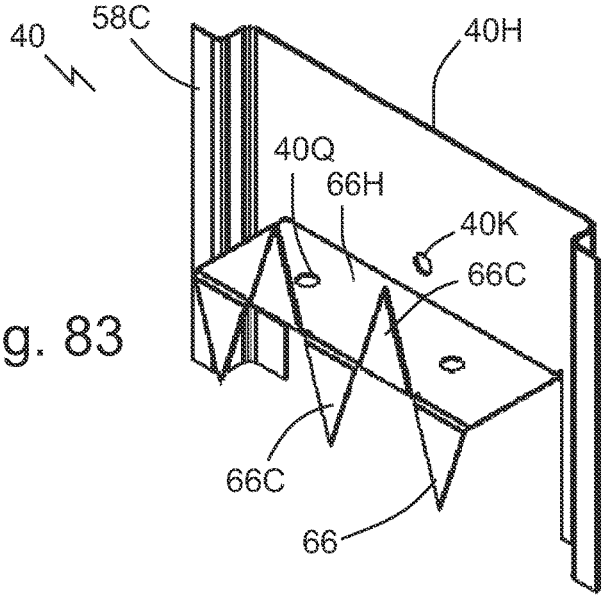
Figure 85:
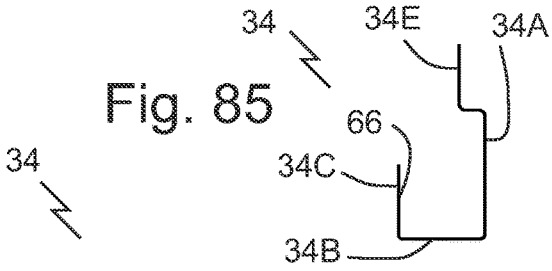
FIGS. 85-88 are end elevation, top plan, top plan, and perspective views, respectively of a starter strip panel connector part.

Referring to FIGS. 80-83, different embodiments of panel connector parts 40 are shown that might function as a suitable end-clip in the system 10 of FIG. 61. In the example shown drainage spacing is provided by drainage spacer parts 58, for example shoulders 58C that extend out of mount 40H in a lateral direction. FIG. 84 illustrates a variation of the end-clip of FIG. 80 but with drainage spacing provided by insulative pad 72.

Referring to FIGS. 49-51 and 61, an example of a top-clip for connecting the top row of panels 12" is illustrated. The top-clip is formed by a top strip 36, which may be a flashing strip, such as a Z-flashing strip, which is secured to the building wall 11. The only difference between the strip 36 in FIGS. 49-51 and the one in FIG. 61 is that in FIG. 61, an insulative pad 72 is provided as a drainage spacer part, to assist in defining drainage system 22 between wall 11 and panels 12. A suitable strip 36 may have a suitable structure, for example a wall mounting strip 34A, from which extends a flange 36B in a lateral direction, from which depends a skirt 36C in a downward direction over the front faces 12B of the panels 12". The skirt 36C may be reinforced, for example by bending the skirt 36C back on itself and forming a reinforcing tab 36D. Other forms and shapes of strips 36 and the features thereof may be used.

Other variations may be used to provide parts 40. For example, a magnet version may be used, where a ferromagnetic part on either the panel 12 or part 40 attracts the other to hold the panel 12 over the insulating layer 60 and/or wall while the adhesive sets. In addition, a threaded version may be used, where the part 56 is a threaded fastener that threads to a washer on the panel 12. The part 40 may be used to hang panels 12 over insulating layer 60 and/or wall 11, for example if used in the embodiment of FIG. 7.

Figure 80:
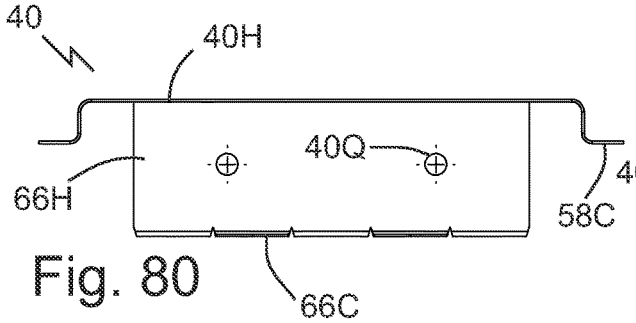
FIGS. 80-83 are top plan, side elevation, end elevation, and perspective views, respectively, of an end-clip panel connector part
Figure 91:
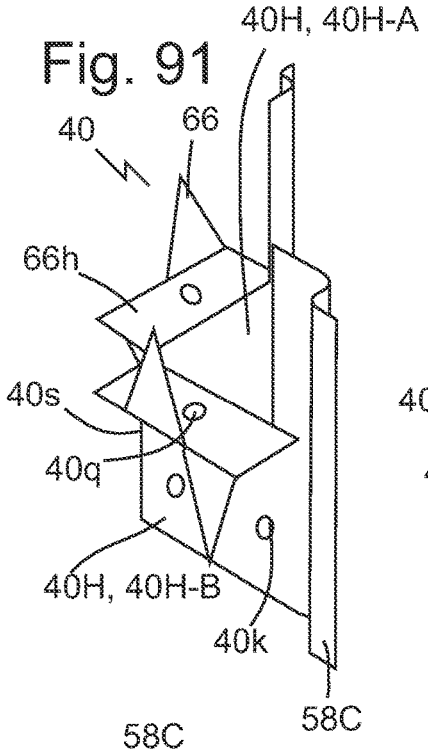
FIGS. 91, 93, and 95 are perspective views.
Figure 93:
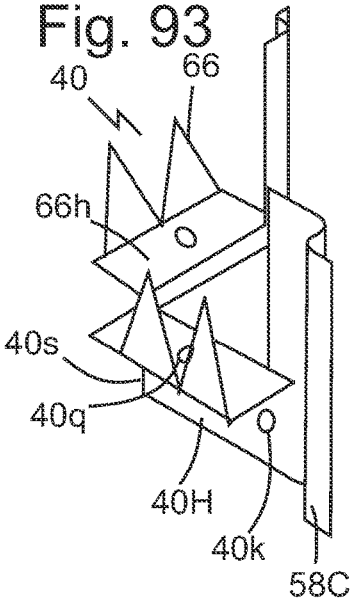
Figure 95:
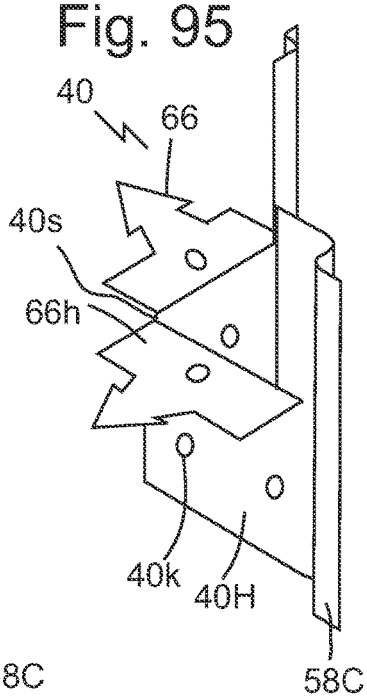
Figure 92:
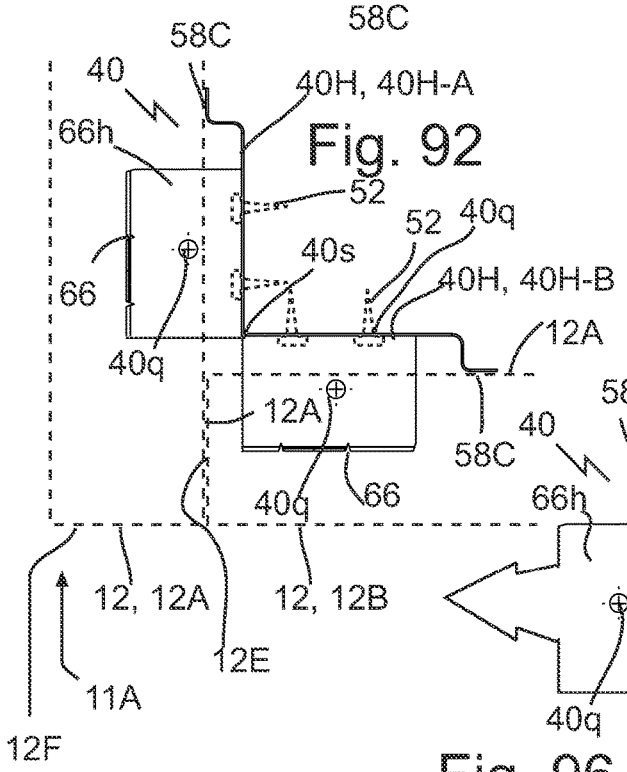
FIGS. 92, 94, and 96 are top plan views, of end clip, starter row clip, and mid-clip panel connector parts, respectively, structured to mount at or around a corner edge of the building wall to connect abutting wall cladding panels from both sides of the corner edge.
Figure 94:
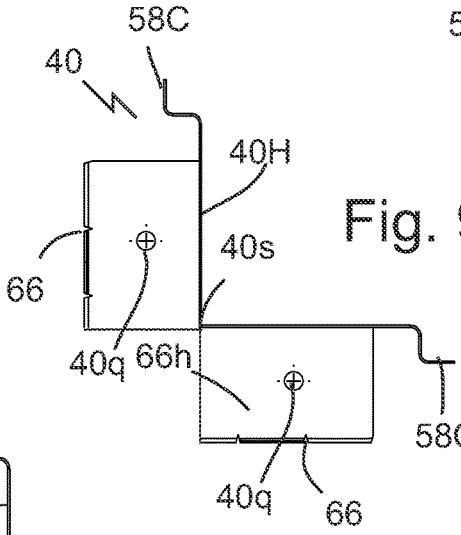
Figure 96:
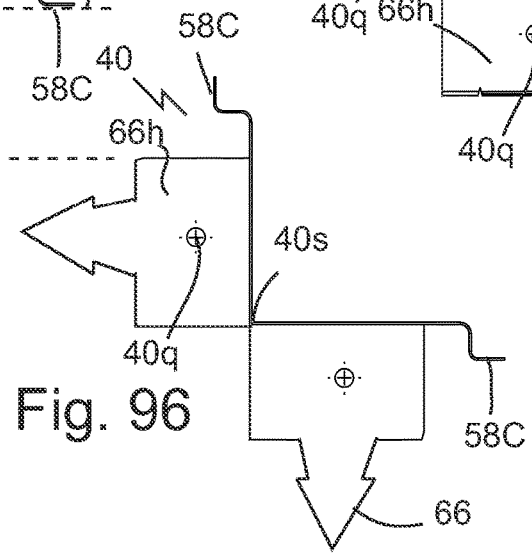

Referring to FIGS. 91-96, the panel connector parts 40 may be adapted to use at or around corner edges 11A (FIG. 92) of a building wall 11. Referring to FIGS. 91-92, an end clip connector part 40 similar to the part shown in FIG. 80 is illustrated, except that the base mount 40H of part 40 is bent into two corner wings 40H-A, 40H-B, about a corner axis 40*s*. In use, the base mount 40H mounts along corner edge 11A of wall 11, spanning the corner edge 11A, to permit fastener parts 66 to engage abutting panels 12A, 12B from the respective sides of the wall 11. Each corner wing 40H-A, 40H-B or one of them may be mounted to the wall 11 by a suitable mechanism, such as fasteners 52, for further example passed through apertures 40*k* in base mount 40H or wings 40H-A, 40H-B. In the example shown, the part 40 is structured to fit about a 90-degree corner of wall 11, however, part 40 may be structured to fit about other angles of corners of wall 11. In the example shown, the fastener parts 66 of wings 40H-A and 40H-B engage rear faces 12A of panels 12A, 12B, respectively. In some cases, the parts 40 may engage end edges 12E, 12F, or top, bottom edges 12C, 12D (not shown) of panels 12. Adhesive (not shown) may be used to secure the edges of the abutting panels 12 together. Referring to FIGS. 93-94, a panel connector part 40 similar to part 40 of FIG. 48 is illustrated, except that the base mount 40H is again split into dual corner wings. The part 40 of FIG. 93 is structured to operate as a starter row clip, but could also be used as a top clip, for a wall of panels 12. Referring to FIGS. 95-96, a panel connector part 40 similar to part 40 of FIG. 65 is illustrated, except that the base mount 40H is again split into dual corner wings. The part 40 of FIG. 95 is structured to operate as a mid-clip.

Referring to FIGS. 1-3 and 7-8, the system 10 may be provided in kit form. A kit may comprise the plurality of wall cladding panels 12, the wall connector parts 42, and the panel connector parts 40. A kit may comprise the wall cladding panels 12 and panel connector parts 40.

In some cases, from exterior sheathing of building wall 11 to the exterior of the system 10, an embodiment may have a weather resistive barrier (WRB), with the panel including drainage, drying cavity, double sided tape on the panel against the WRB, insulation, and an external finishing layer, forming an all-in-one finished product. A continuous thermal breaking panel may be provided. All fasteners may be installed from the rear face 12A of the panels, eliminating fasteners going from the exterior of the panels 12 to the studs 26. Embodiments of the system 10 may have one or more of the following advantages:

1) non combustibility;
2) continuous insulation to avoid thermal bridging;
3) drainage/air cavity;
4) double sided tape installed vertically against the rear of panel; and
5) a receiver cap (wall connector part 42) with a thermal break.

Suitable fasteners may be used in the embodiments of this document. For example, a fastener may have a narrow tip for penetrating materials, and threading. Fasteners may be self-tapping screws. Each fastener may have a head, which may incorporate a suitable screwdriver connector, such as a Robertson, Phillips, hex, or other suitable connector. Other suitable fasteners may be used, such as nails (not shown).

Words such as above, below, over, under, horizontal and vertical, and others, are understood to be relative and not defined with respect to gravitational acceleration on the Earth, unless context dictates otherwise. The word spaced refers to the parts being separated. The clips or parts 40, 42 used in this document may vary by dimensions, such as size and shape and length and width of the part 66, tab 68, base wall mount 40H.

In the claims, the word "comprising" is used in its inclusive sense and does not exclude other elements being present. The indefinite articles "a" and "an" before a claim feature do not exclude more than one of the features being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A wall cladding system comprising:
a building wall;
a plurality of wall cladding panels each comprising a layer of insulating material and defining a rear face, a front face, and edges, with adjacent of the wall cladding panels abutting one another along respective side edges; and
panel connector parts mounted on the building wall and having one or more lance parts that engage:
the edges of the layer of insulating material of the plurality of wall cladding panels at intermediate locations, spaced from the front faces, of each of the layer of insulating material of the plurality of wall cladding panels, with the panel connector parts spaced from the front faces to mount the plurality of wall cladding panels as a continuous thermal break layer against the building wall.

2. The wall cladding system of claim 1 in which:
the building wall comprises a first layer of insulating material and a wall frame;
the panel connector parts are mounted on and secure the first layer of insulating material to the wall frame; and
the layer of insulating material of each of the plurality of wall cladding panels comprises a second layer of insulating material that overlies, and is secured by the panel connector parts to, the first layer of insulating material.

3. The wall cladding system of claim 2 in which one or both of the first layer of insulating material and the second layer of insulating material comprise mineral wool.

4. The wall cladding system of claim 1 in which the panel connector parts are structured to space the rear faces of the plurality of wall cladding panels off of the building wall to define a drainage cavity.

5. The wall cladding system of claim 4 in which the panel connector parts each comprise:
a base wall mount; and one or more drainage spacer parts that extend out of the base wall mount to space the rear faces of the building wall to define the drainage cavity.

6. The wall cladding system of claim 5 in which the one or more drainage spacer parts each comprise an insulating backing layer.

7. The wall cladding system of claim 4 further comprising second panel connector parts that engage the rear faces of the plurality of wall cladding panels at interior locations, spaced from the side edges, of each of the plurality of wall cladding panels.

8. The wall cladding system of claim 7 in which the second panel connector parts comprise the one or more lance parts, which extend out of an exterior face of a base wall mount toward a respective wall cladding panel.

9. The wall cladding system of claim 8 in which the one or more lance parts define a fastener part that defines a leading tip that extends in a lateral direction into the rear face of a respective wall cladding panel, at an interior location, spaced from the edges, of the respective wall cladding panel.

10. The wall cladding system of claim 9 in which the leading tips have a triangular shape.

11. The wall cladding system of claim 9 in which the fastener parts comprise one-way fastener parts.

12. The wall cladding system of claim 11 in which the one-way fastener parts each comprise one or more of a pull-out restricting tab, barbs, shark teeth, and ridges.

13. The wall cladding system of claim 1 in which the one or more lance parts define a fastener part that defines a leading tip that extends into the edges of the plurality of wall cladding panels at the intermediate locations.

14. The wall cladding system of claim 13 in which the one or more lance parts that extend into the edges comprise:

a flange that extends out of the exterior face of the base wall mount in a lateral direction; and the fastener part that defines the leading tip that extends one or both of upward or downward from the flange into the edges of the layer of insulating material of the plurality of wall cladding panels.

15. The wall cladding system of claim 1 in which at least some of the panel connector parts engage abutting edges of adjacent of the plurality of wall cladding panels.

16. The wall cladding system of claim 1 in which at least some of the panel connector parts are mounted around a corner edge of the building wall.

17. The wall cladding system of claim 1 in which the plurality of wall cladding panels comprise a starter row of wall cladding panels mounted on a panel connector part that forms a starter hanger and is secured to the building wall.

18. The wall cladding system of claim 17 in which the starter hanger comprises:

a mounting strip secured to the building wall;

a flange that extends laterally off the mounting strip away from the building wall to support a base end of the plurality of wall cladding panels that form the starter row; and one or more lance parts, which define fastener parts that each define a leading tip that extends upward from the flange into the edges of the layer of insulating material of the plurality of wall cladding panels of the starter row.

19. The wall cladding system of claim 1 in which the plurality of wall cladding panels comprise a top row of wall cladding panels mounted by a Z-flashing strip that is secured to the building wall.

20. The wall cladding system of claim 1 in which the panel connector parts are formed out of a sheet of material that is bent to form the panel connector part.

21. The wall cladding system of claim 1 in which, one or more of the following features are present:

the plurality of wall cladding panels are arranged in two or more vertically stacked, horizontal rows;

each of the plurality of wall cladding panels comprise an external decorative finishing layer defining an external face of the wall cladding panel; and adhesive secures the plurality of wall cladding panels to the building wall.

22. A method comprising assembling the wall cladding system of claim 1 on the building wall.

23. A method of assembling a wall cladding system on a building wall, the method comprising:

mounting a plurality of panel connector parts along the building wall, the panel connector parts having one or more lance parts;

mounting a plurality of wall cladding panels along an exterior of the building wall, such that the one or more lance parts of the plurality of panel connector parts align and engage:

the edges of the layer of insulating material of the plurality of wall cladding panels, at intermediate locations, spaced from a front face of, of each of the layer of insulating material of the plurality of wall cladding panels, with the panel connector parts spaced from the front faces to mount the plurality of wall cladding panels as a continuous thermal break layer against the building wall.

24. The method of assembling the wall cladding system on a building wall of claim 23 further comprising a plurality of second panel connector parts align and engage a rear face of, and at interior locations, spaced from edges of, each of the plurality of wall cladding panels.

25. A kit comprising:

a plurality of wall cladding panels each comprising insulating material and defining a rear face, a front face, and edges, with the edges of the wall cladding panels structured to mate with abutting edges of adjacent of the wall cladding panels in use; and panel connector parts, in which the panel connector parts are structured to mount to the building wall at suitable locations, and with the panel connector parts spaced from front faces of the plurality of wall cladding panels to mount the plurality of wall cladding panels as a continuous thermal break layer against the building wall when the panel connector parts are mounted to the building wall, by having one or more lance parts that are structured to engage in use:

the edges of the layer of insulating material of the plurality of wall cladding panels, at intermediate locations, spaced from front faces of, each of the layer of insulating material of the plurality of the wall cladding panels.

26. The kit of claim 25 further comprising second panel connector parts that are mounted to the building wall by engaging the rear face of, and at interior locations, spaced from the edges of, each of the plurality of wall cladding panels.

* * * * *